US011008124B2

(12) United States Patent
Kitago

(10) Patent No.: US 11,008,124 B2
(45) Date of Patent: May 18, 2021

(54) MANUAL BUNDLING TOOL

(71) Applicant: HellermannTyton Co., Ltd., Tokyo (JP)

(72) Inventor: Toru Kitago, Himeji (JP)

(73) Assignee: HellermannTyton Co., Ltd., Tokyo (JP)

( * ) Notice: Subject to any disclaimer, the term of this patent is extended or adjusted under 35 U.S.C. 154(b) by 101 days.

(21) Appl. No.: 16/093,432

(22) PCT Filed: Apr. 18, 2016

(86) PCT No.: PCT/JP2016/062229

§ 371 (c)(1),
(2) Date: Oct. 12, 2018

(87) PCT Pub. No.: WO2017/183074

PCT Pub. Date: Oct. 26, 2017

(65) Prior Publication Data

US 2019/0210749 A1 Jul. 11, 2019

(51) Int. Cl.

| | |
|---|---|
| ***B65B 13/02*** | (2006.01) |
| ***B65B 13/22*** | (2006.01) |
| ***B65B 13/18*** | (2006.01) |

(52) U.S. Cl.
CPC ..... *B65B 13/027* (2013.01); *B65B 13/18* (2013.01); *B65B 13/22* (2013.01)

(58) Field of Classification Search
CPC ..... B65B 13/025; B65B 13/027; B65B 13/18; B65B 13/185; B65B 13/22; B65B 13/30; B65B 13/305; B65B 13/34; B65B 13/345
(Continued)

(56) References Cited

U.S. PATENT DOCUMENTS 4,928,738 A * 5/1990 Marelin ..... B65B 13/027 140/123.6
4,947,901 A * 8/1990 Rancour ..... B65B 13/027 140/123.6

(Continued)

FOREIGN PATENT DOCUMENTS

CH 629719 A3 5/1982
CH 629719 A5 5/1982

(Continued)

OTHER PUBLICATIONS

English Machine Translation of WO2014024295A1: "Manual Bundling Tool" (Published: Feb. 2014) (Year: 2014).*

(Continued)

*Primary Examiner* — Edward T Tolan
*Assistant Examiner* — Katie L. Parr
(74) *Attorney, Agent, or Firm* — Colby Nipper PLLC

(57) ABSTRACT

A manual bundling tool has a first operating means that positionally shifts relative to a tool body opposite a handle. A tightening mechanism pulls an other end of a cable tie band in relative to a head part by positionally shifting the first operating means. A holding mechanism holds the other end side of the band part pulled by the tightening mechanism so as to prevent return movement. A second operating means positionally shifts relative to the tool body. A securing mechanism secures the other end side of the band part to the one end side of the band part in response to positionally shifting the second operating means. A release operation means positionally shifts relative to the tool body and a release mechanism releases the hold on the cable tie band part by the holding mechanism in response to a positionally shifting the release operation means.

11 Claims, 22 Drawing Sheets

(58) Field of Classification Search
USPC ..... 140/93 A, 57, 123.6; 100/29–33 PB
See application file for complete search history.

(56) References Cited

U.S. PATENT DOCUMENTS

| | | | | |
|---|---|---|---|---|
| 5,167,265 | A | 12/1992 | Sakamoto | |
| 5,205,328 | A * | 4/1993 | Johnson | B65B 13/027 140/93 A |
| 6,206,053 | B1 * | 3/2001 | Hillegonds | B65B 13/027 140/123.6 |
| 7,059,362 | B2 * | 6/2006 | Koons | B25B 23/0092 140/123.5 |
| 9,481,102 | B1 * | 11/2016 | Hojnacki | B26D 5/10 |
| 2002/0179175 | A1 * | 12/2002 | Finzo | B65B 13/305 140/93.2 |
| 2005/0005993 | A1 * | 1/2005 | Magno, Jr. | B65B 13/22 140/123.6 |
| 2005/0115629 | A1 * | 6/2005 | Bernard | B65B 13/027 140/123.5 |
| 2006/0243341 | A1 * | 11/2006 | Bernard | B65B 13/24 140/123.5 |
| 2007/0267085 | A1 * | 11/2007 | Bae | B65B 13/027 140/93.2 |
| 2008/0092981 | A1 * | 4/2008 | Hillegonds | B65B 13/027 140/93.4 |
| 2009/0121069 | A1 | 5/2009 | Dyer et al. | |
| 2015/0151862 | A1 | 6/2015 | Kitago | |
| 2015/0239588 | A1 | 8/2015 | Kitago | |
| 2017/0015449 | A1 * | 1/2017 | Marelin | B65B 13/027 |
| 2019/0127095 | A1 | 5/2019 | Kitago | |

FOREIGN PATENT DOCUMENTS

| | | | |
|---|---|---|---|
| CN | 201077538 | Y | 6/2008 |
| CN | 102642632 | A | 8/2012 |
| EP | 506228 | A1 | 9/1992 |
| GB | 1395859 | A | 11/1973 |
| JP | 2-4614 | A | 1/1990 |
| JP | 7-2005915 | A | 8/1995 |
| JP | H10152113 | | 6/1998 |
| JP | 2006240695 | A | 9/2006 |
| JP | 2009262965 | A | 11/2009 |
| JP | 2012144257 | A | 8/2012 |
| WO | 2014024295 | A1 | 2/2014 |
| WO | 2014024296 | A1 | 2/2014 |

OTHER PUBLICATIONS

English Abstract Translation CH629719, published May 14, 1982.
English Abstract Translation of CN 102642632A, published Aug. 22, 2012.
English Abstract Translation of CN 201077538Y, published Jun. 25, 2008.
"Foreign Office Action", EP Application No. 16899348.3, dated Nov. 12, 2020, 3 pages.
"Foreign Office Action", CN Application No. 201680085764.2, dated Dec. 2, 2020, 7 pages.
"Extended European Search Report", EP Application No. 16899347.5, dated Nov. 11, 2019, 8 pages.
"Foreign Notice of Allowance", JP Application No. 2018-512652, dated Dec. 3, 2019, 5 pages.
"Foreign Office Action", CN Application No. 201680085764.2, dated Mar. 25, 2020, 12 pages.
"Foreign Office Action", CN Application No. 201680086856.2, dated Apr. 16, 2020, 12 pages.
"Foreign Office Action", EP Application No. 16899347.5, dated May 11, 2020, 3 pages.
"Foreign Office Action", JP Application No. 2018-512653, dated Sep. 24, 2019, 14 pages.
"Non-Final Office Action", U.S. Appl. No. 16/093,414, dated Jul. 23, 2020, 24 pages.
Pursuant to MPEP § 2001.6(b) the applicant brings the following co-pending application to the Examiner's attention: U.S. Appl. No. 16/093,414.
"Final Office Action", U.S. Appl. No. 16/093,414, dated Feb. 16, 2021, 13 pages.
"Foreign Office Action", EP Application 16899347.5, dated Mar. 5, 2021, 4 pages.
"Notice of Allowance", U.S. Appl. No. 16/093,414, dated Mar. 23, 2021, 12 pages.

* cited by examiner

MANUAL BUNDLING TOOL

CROSS-REFERENCE TO RELATED APPLICATIONS

This application is a national stage application under 35 U.S.C. § 371 of PCT Application Number PCT/JP16/62229 having an international filing date of Apr. 18, 2016, which designated the United States, the entire disclosure of which is hereby incorporated herein by reference.

TECHNICAL FIELD OF THE INVENTION

The present invention relates to a manual bundling tool.

BACKGROUND OF THE INVENTION

Conventionally, manual bundling tools used for metal cable ties have been known. This type of manual bundling tool is equipped with a tightening means, which pulls the band part after passing through the head part of the cable tie relative to the head part, a securing mechanism, which secures the tip end side of the band part to the base end using the head part, and a holding mechanism, which holds the band part so as to prevent return movement toward the head part side.

The above manual bundling tool is further equipped with a tool body which includes a handle and a lever which opposes the handle. The aforementioned manual bundling tool is configured such that when the handle and the lever are rotated, the tightening mechanism is operated until the tension produced by the tightening mechanism reaches a maximum value (set value), and when it reaches the set value, the securing mechanism is operated instead of the tightening mechanism.

Additionally, the aforementioned manual bundling tool is configured such that during cable tie mounting, the band part is held by the holding mechanism to prevent the band part from easily falling out of the tool body. Therefore, once the cable tie is mounted in the manual bundling tool, the cable tie cannot be removed from the manual bundling tool without damaging the cable tie because of the action of the holding mechanism.

Thus, when performing the bundling operation, if the cable tie is mounted on the manual bundling tool when, for example, there is an error in the tightening position of the cable tie relative to the bundled objects or the bundled objects are insufficient, the operations on the cable tie cannot be redone without labor such as cutting and removing the cable tie and preparing a new cable tie.

SUMMARY OF THE INVENTION

The present invention was achieved taking such circumstances into consideration, and an object thereof is to improve the convenience of bundling operations that use cable ties.

According to one aspect of the present invention, a manual bundling tool can be used for a cable tie for bundling bundled objects with the metal cable tie having a belt-shaped band part and a head part provided on one end of the band part in the lengthwise direction. The tool includes a tool body having a housing, a handle projecting from the housing, and a setting part connected to the housing and formed so as to be capable of setting the head part of the cable tie. A first operating means is capable of positional shift relative to the tool body so as to oppose the handle. A tightening mechanism is capable of pulling another end side of the band part in the lengthwise direction after passing through the head part set in the setting part, in a direction away from the head part in response to a positional shift operation of the first operating means. A holding mechanism is capable of holding the other end side of the band part in the lengthwise direction pulled by the tightening mechanism, on the tool body so as to prevent return movement toward the head part side. A second operating means is capable of positional shift relative to the tool body. A securing mechanism capable of securing the other end side of the band part in the lengthwise direction passing through the head part set in the setting part, to the one end side of the band part in the lengthwise direction in response to a positional shift operation of the second operating means. A release operation means is capable of positional shift relative to the tool body and a release mechanism is capable of releasing the hold on the other end side of the cable tie band part in the lengthwise direction by the holding mechanism in response to a positional shift of the release operation means.

According to another aspect of the present invention, the tool body has a pistol shape, and the setting part is disposed in a region equivalent to a muzzle portion on the tool body.

According to a further aspect of the present invention, the setting part is provided on the tool body such that the other end side of the band part in the lengthwise direction after passing through the head part set in the setting part is positioned on a side opposite the handle and sandwiching the housing.

According to yet another aspect of the present invention, the setting part is mounted on the housing such that it can be attached and detached.

According to another aspect of the present invention, the second operating means is configured using the first operating means and a switching operation means for switching a mechanism that operates according to a positional shift of the first operating means, between the tightening mechanism and the securing mechanism.

According to another aspect of the present invention, the switching operation means is mounted on the first operating means so as to be capable of positional shift integrally with the first operating means relative to the tool body and so as to be capable of positional shift relative to the first operating means, such that the handle and the first operating means can be grasped individually or together.

According to another aspect of the present invention, the manual bundling tool further comprises a mechanism which disables switching by the switching operation means during positional shift of the first operating means.

According to another aspect of the present invention, the manual bundling tool further comprises a third operating means capable of positional shift relative to the tool body and a disconnect mechanism capable of disconnecting the other end side of the band part in the lengthwise direction after passing through the head part set in the setting part, to separate it in the lengthwise direction of the band part in response to a positional shift operation of the third operating means.

According to another aspect of the present invention, the second operating means and the third operating means are identical operating means.

According to the present invention, provided is a manual bundling tool capable of improving the convenience of bundling operations that use cable ties.

DETAILED DESCRIPTION OF THE INVENTION

First, the configuration of a manual bundling tool 1 according to an embodiment of the present invention will be described while referencing the drawings. Note that in the descriptions below, the direction of the X arrow in FIG. 1 is considered the forward direction of the manual bundling tool 1, the direction of the Y arrow is considered the upward direction of the manual bundling tool 1, and the direction of the Z arrow is considered the leftward direction of the manual bundling tool 1.

Figure 1:
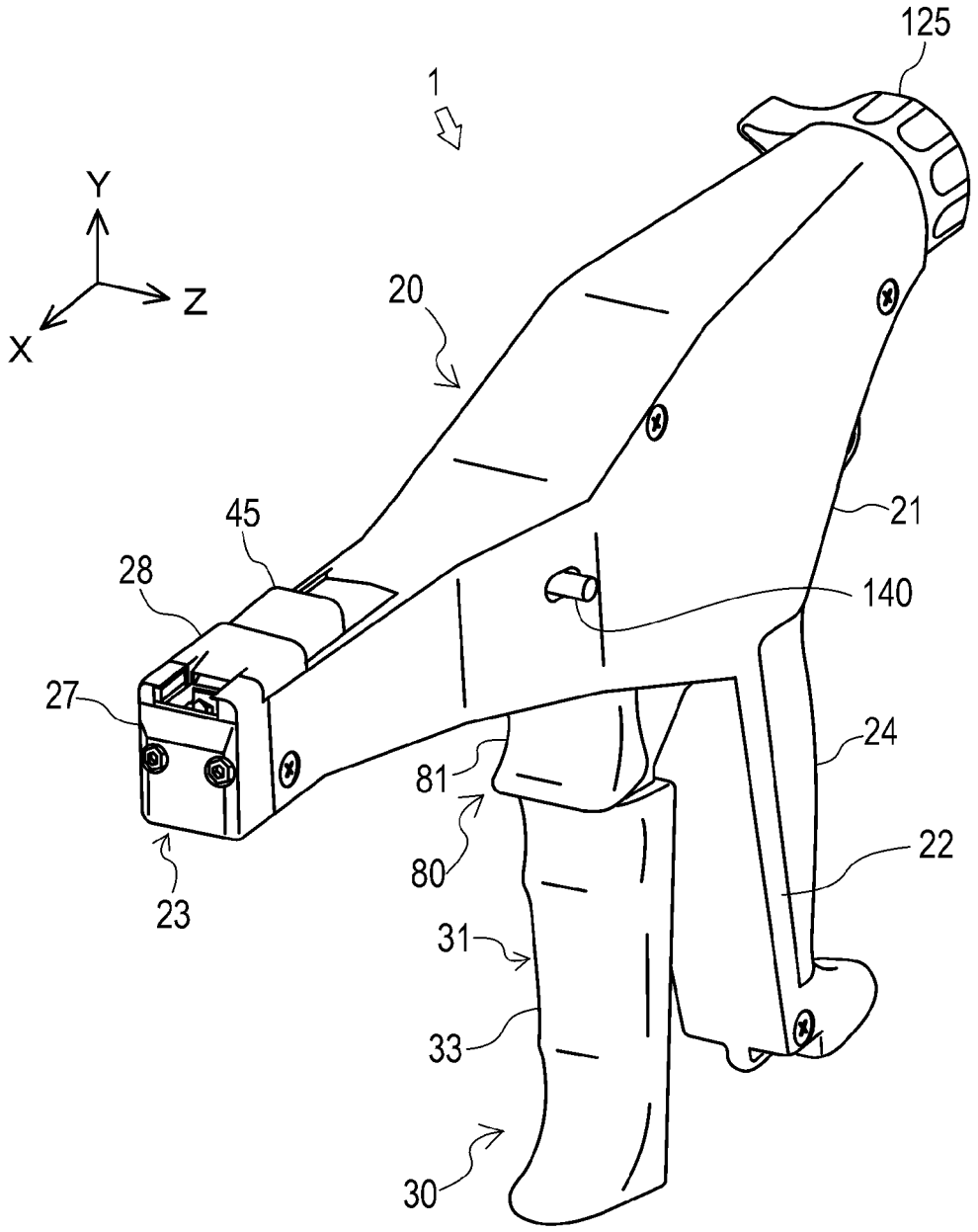
FIG. 1 is a perspective view of a manual bundling tool according to an embodiment of the present invention.
Figure 2:
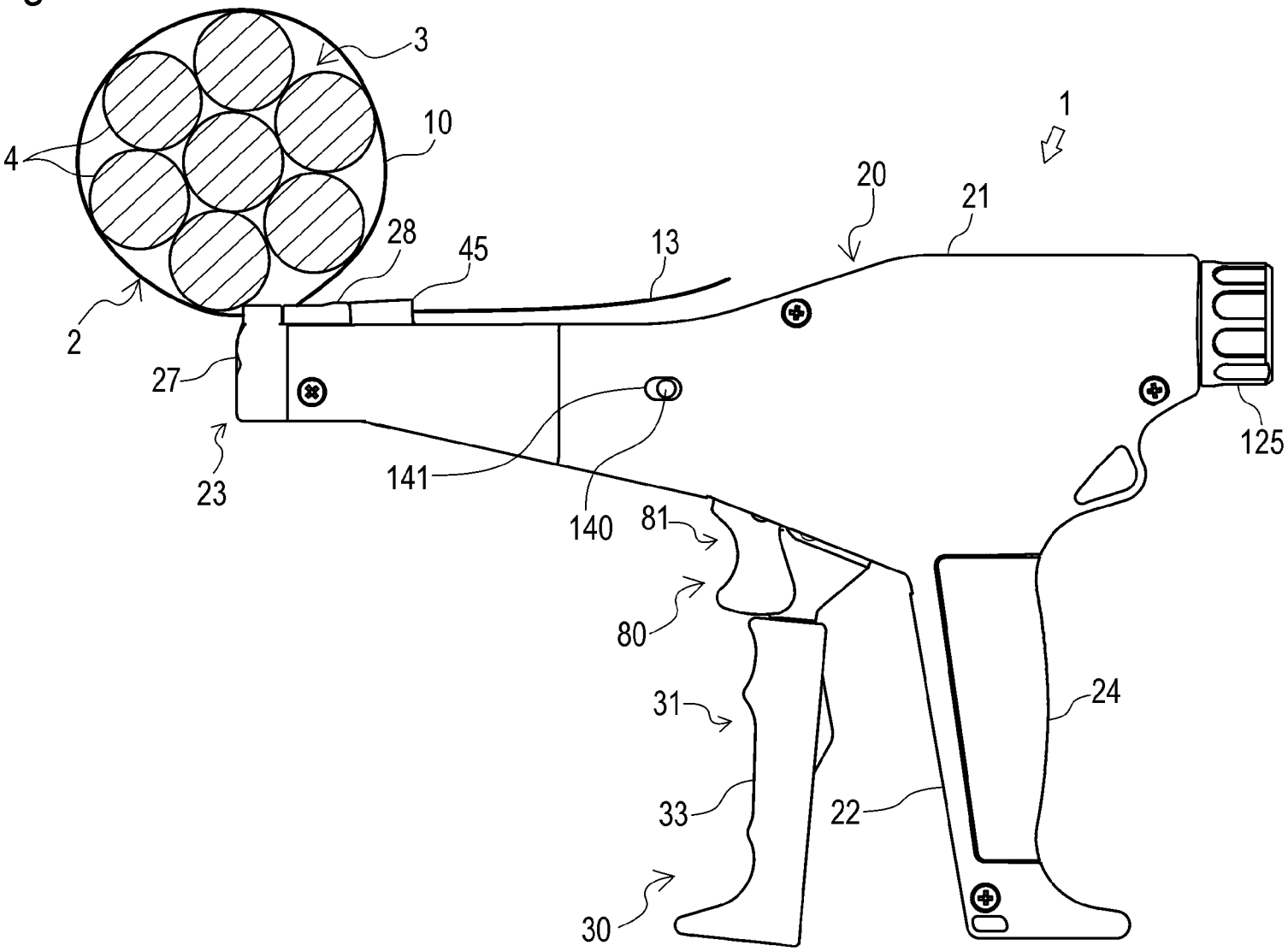
FIG. 2 is a side view of the manual bundling tool of FIG. 1.
Figure 3A:
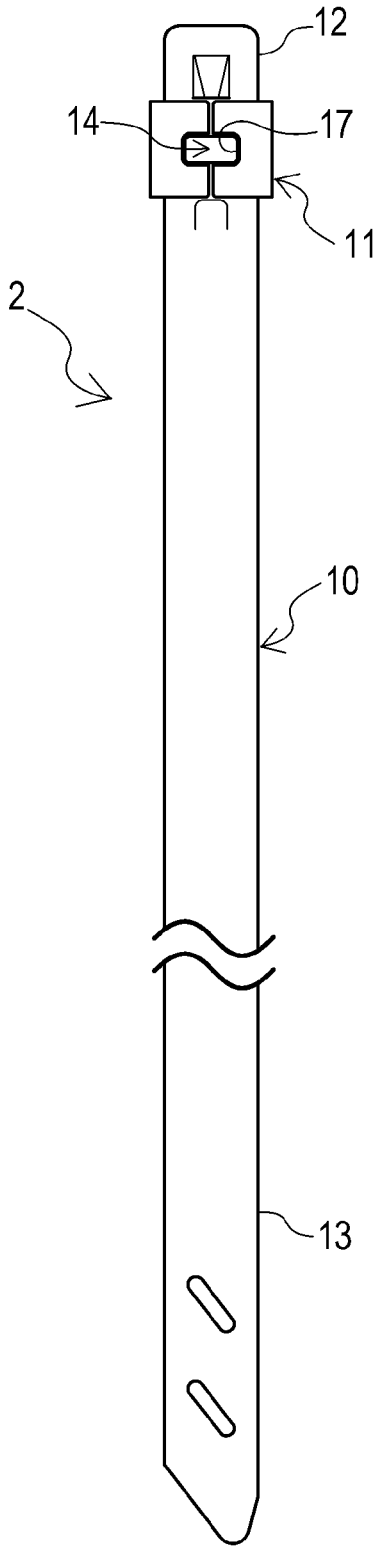
FIG. 3A is a front view of a cable tie used for the manual bundling tool of FIG. 1.
Figure 3B:
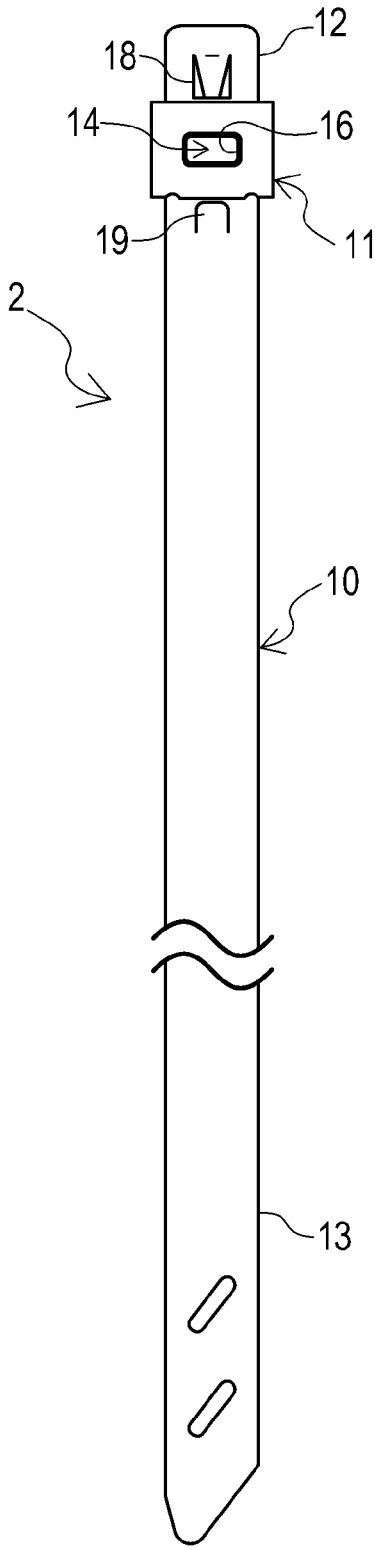
FIG. 3B is a rear view of this cable tie.
Figure 4A:
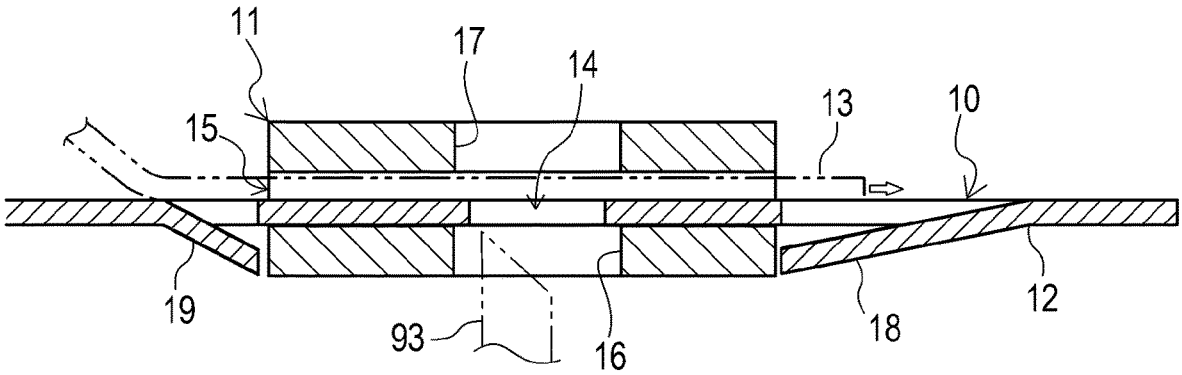
FIG. 4A is a longitudinal section view of the base end side of the cable tie of FIG. 3.
Figure 4B:
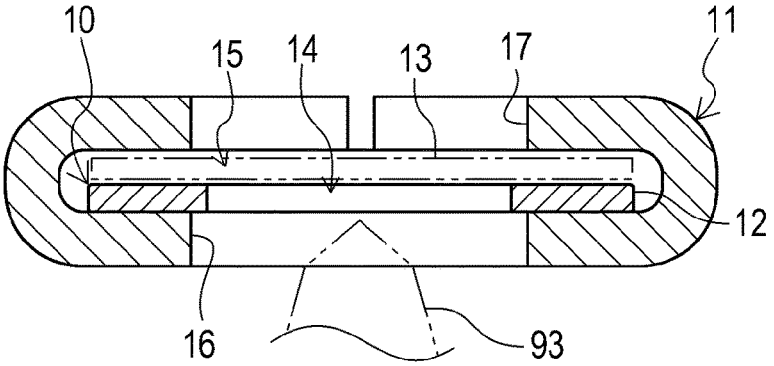
FIG. 4B is a lateral section view of this base end side.

As illustrated in FIGS. 1 and 2, the manual bundling tool 1 can be used for a cable tie 2 to bundle bundled objects 3 (for example, a bundle of linear members 4 such as wires or pipes) with the metal cable tie. As illustrated in FIG. 3, the cable tie 2 has a belt-shaped band part 10 and a head part 11 provided on one end (base end) 12 of the band part 10 in the lengthwise direction.

Also, the manual bundling tool is configured such that the other end (tip end) 13 side of the band part 10 in the lengthwise direction after being wrapped around the bundled objects 3 and passing through the head part 11 is pulled relative to the head part 11, and the tip end 13 side can be secured to the base end 12 using the head part 11 so that the tightened state of the band part 10 is maintained.

In the present embodiment, as illustrated in FIGS. 3A, 3B, 4A and 4B, the band part 10 of the cable tie 2 is constructed using a metal member such as a stainless steel sheet, and is formed into an elongated shape having a prescribed band width. The base end 12 of the band part 10 has a through-hole 14. The tip end 13 of the band part 10 has a tapered shape.

The head part 11 is constructed using a metal member such as a stainless steel sheet, and is shaped into a C shape capable of externally fitting onto the band part 10. The head part 11 has a first opening part 16 and a second opening part 17 which are positioned coaxially with a through-hole 15 through which the band part 10 can pass and the through-hole 14, respectively, and is held on the base end 12 of the band part 10 by projecting parts 18 and 19.

Figure 5:
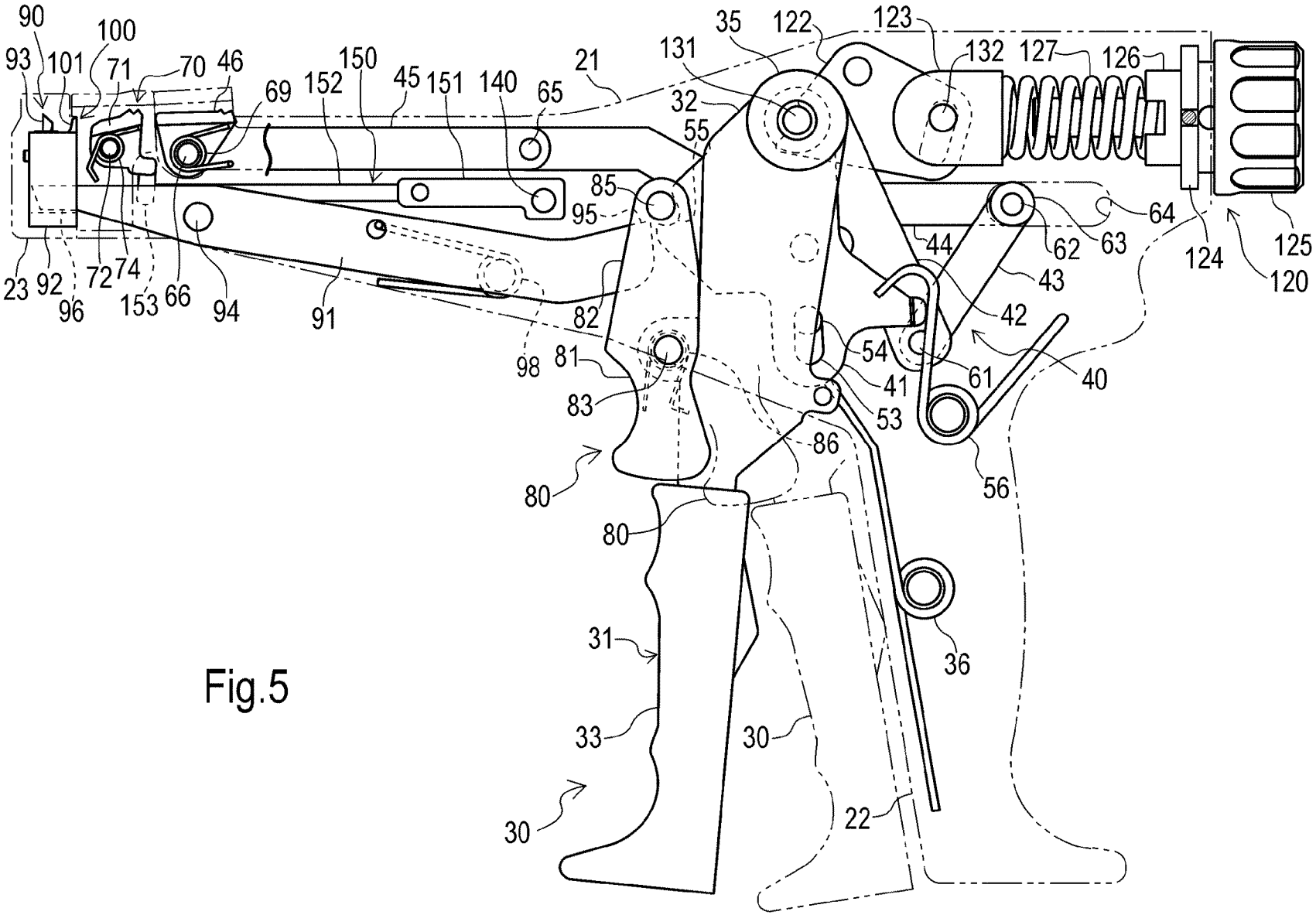
FIG. 5 is a schematic side view of the configuration of the manual bundling tool of FIG. 1.
Figure 6:
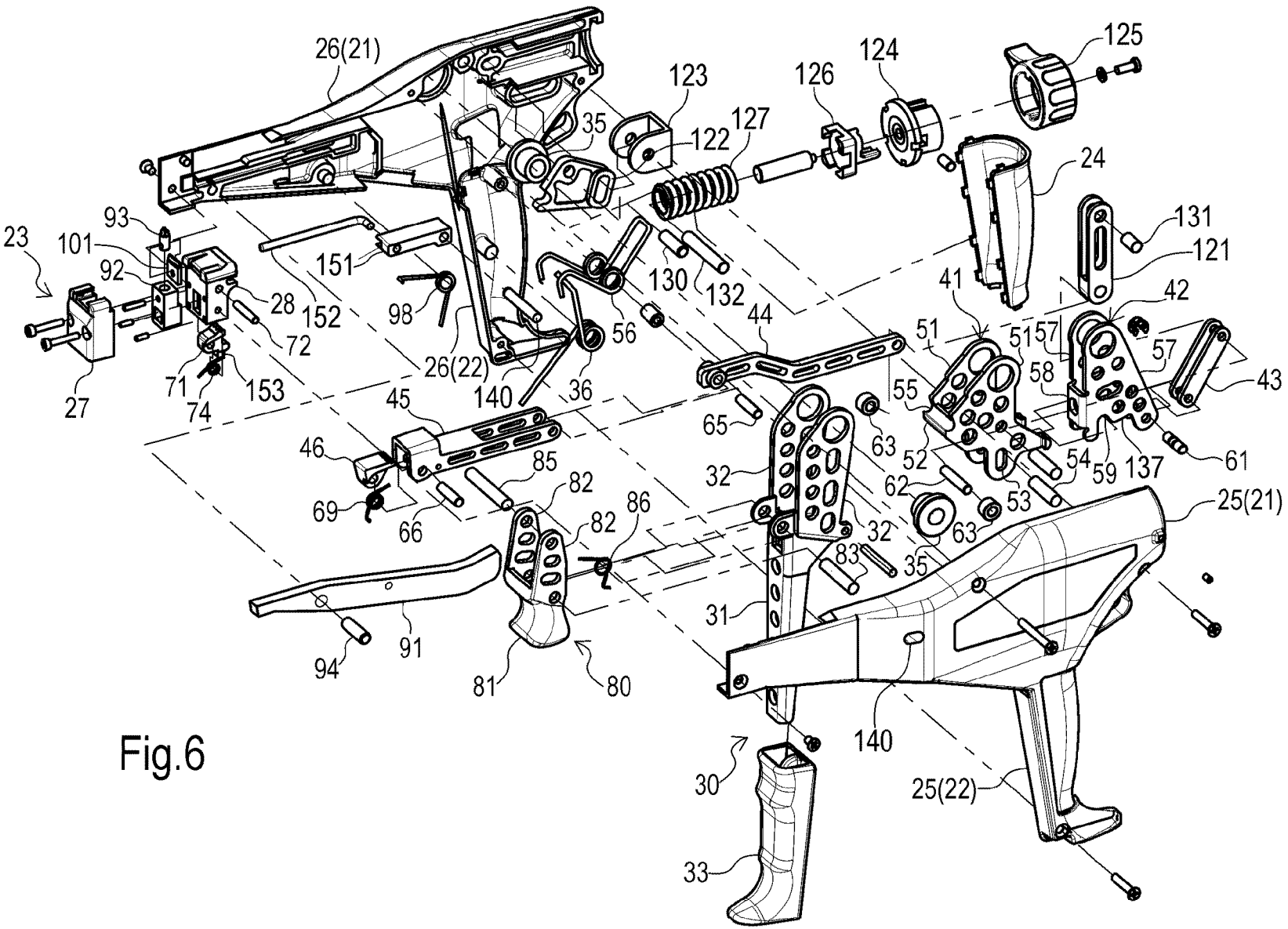
FIG. 6 is an exploded view of the manual bundling tool of FIG. 1.

Furthermore, as illustrated in FIGS. 1 and 2, the manual bundling tool 1 has a tool body 20. As also illustrated in FIG. 5 and FIG. 6, the tool body 20 has a housing 21, a handle 22 which projects from the housing 21, and a setting part 23 which is connected with the housing 21 and is formed so as to be capable of setting the head part 11 of the cable tie 2.

The housing 21 and the handle 22 are constructed using a left part 25 and a right part 26 which can be mutually attached and detached. The housing 21 has a hollow shape and extends in the forward/rearward direction such that the front end (tip end) side becomes narrower than the front/rear intermediate part. The handle 22 projects downward from the front/rear intermediate part of the housing 21. A grip 24 is provided on the handle 22.

In the present embodiment, the tool body 20 has a pistol shape, and the setting part 23 is disposed in a region equivalent to a muzzle portion (front end) on the tool body 20. The setting part 23 is configured such that the head part 11 can be set such that the tip end 13 side of the band part 10 passes through the head part 11 (the through-hole 15) and protrudes rearward therefrom.

Figure 7:
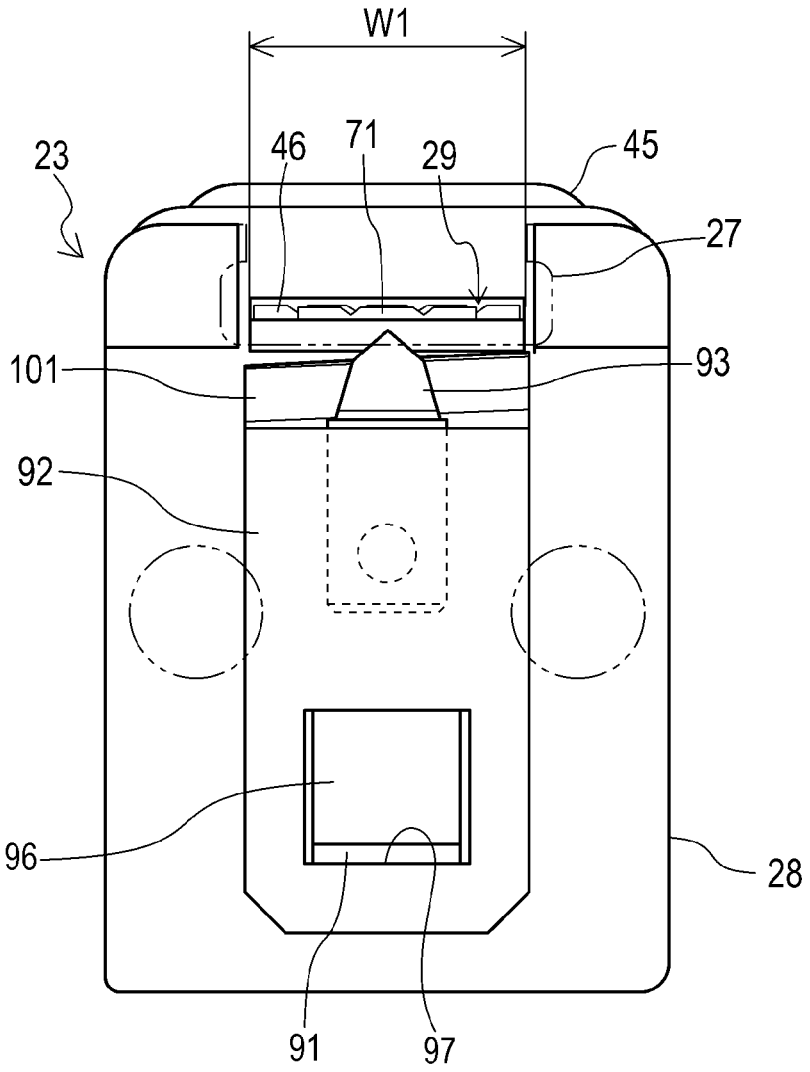
FIG. 7 is a front view of the tip end of the manual bundling tool of FIG. 1.
Figure 8:
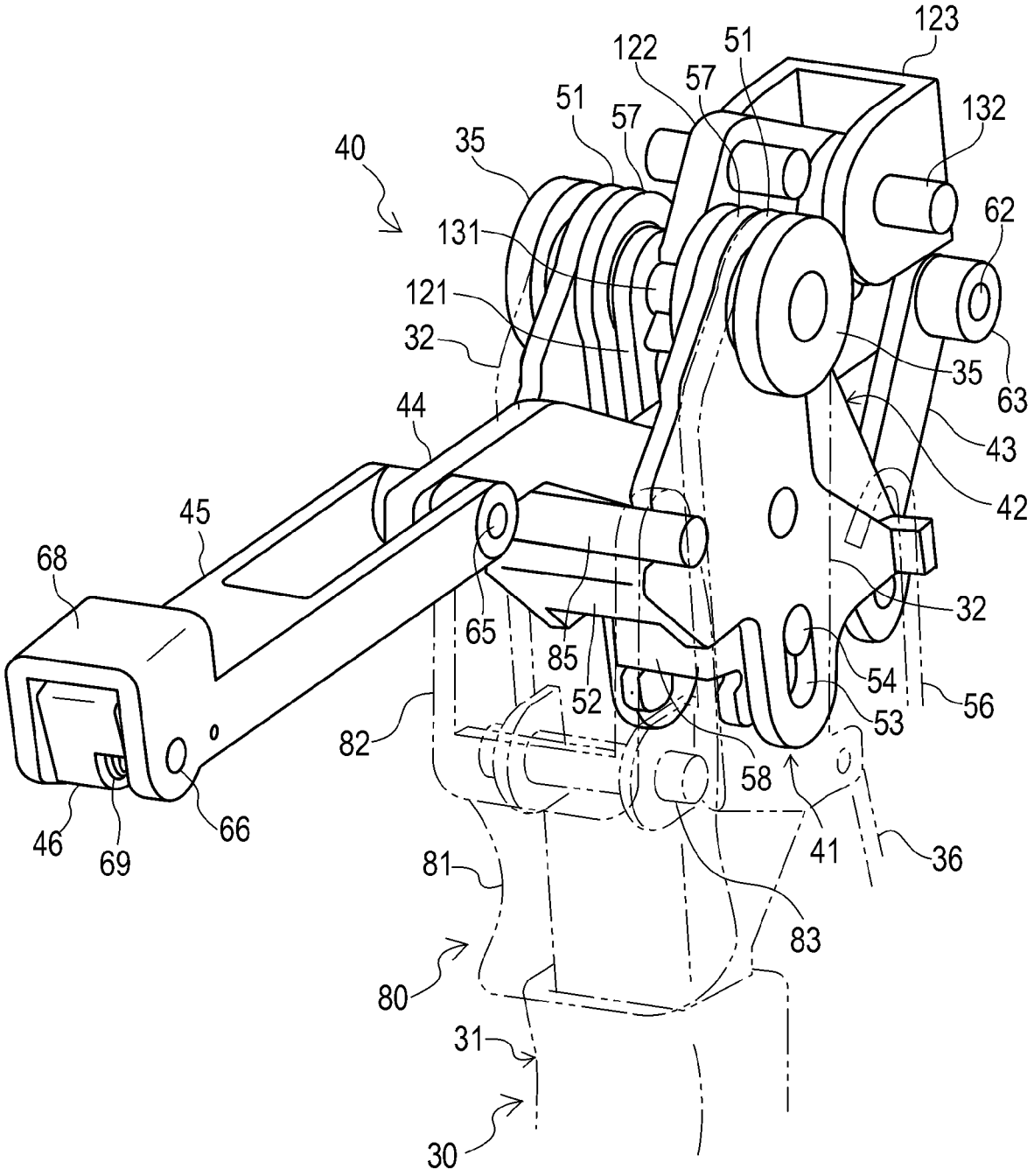
FIG. 8 is a perspective view of the case where the tightening mechanism in the manual bundling tool of FIG. 1 is in the first state.

As also illustrated in FIG. 7, the setting part 23 has a fitting part 27 which can fit the head part 11 from the forward direction, and a guide part 28 which can guide, to the downward direction, the tip end 13 side of the band part 10 which protrudes from the head part 11 fitted into the fitting part 27. The guide part 28 is disposed rearward of the fitting part 27 and includes a front passage route 29 having a width W1 for allowing the tip end 13 side of the band part 10 to pass through.

The manual bundling tool 1 also has a first operating means. The first operating means is capable of positional shift relative to the tool body 20 so as to oppose the handle 22 of the tool body 20. In the present embodiment, the first operating means is a trigger 30 capable of a manual positional shift operation (rotation operation), and has a first operating part 31 and left and right extending parts 32 which extend from the first operating part 31.

The trigger 30 extends in the vertical direction. The first operating part 31 is disposed beneath the housing 21 and forward of the handle 22. A grip 33 is provided on the first operating part 31. The left and right extending parts 32 are disposed mainly inside the housing 21. The left and right extending parts 32 are supported such that they can rotate on a bush 35 held on the housing 21 at each top end.

The trigger 30 is configured such that the first operating part 31 is capable of taking a non-operating position separated by a prescribed amount from the handle 22 (position indicated by the solid line in FIG. 5) or an operating position in which the first operating part 31 is closer to the handle 22 than the non-operating position (position indicated by the dash-dot line in FIG. 5). When not operated, the trigger 30 is held in the non-operating position by the force of a kick spring 36.

On the other hand, when operated against the force of the kick spring 36, the trigger 30 can be rotated in the counterclockwise direction in FIG. 5 with the bush 35 as a fulcrum so that the trigger 30 can take the operating position. When such operation of the trigger 30 ends, the trigger 30 is rotated in the clockwise direction in FIG. 5 by the force of the kick spring 36 so as to return to the non-operating position.

As illustrated in FIGS. 8, 9, 10, 11 and 12, the manual bundling tool 1 has a tightening mechanism 40. The tightening mechanism 40 is configured so as to be capable of pulling the tip end 13 side of the band part 10 after passing through the head part 11 set in the setting part 23, in a direction away from the head part 11 (rearward) in response to a positional shift operation of the trigger 30.

In the present invention, the tightening mechanism 40 is provided inside the housing 21 of the tool body 20, and spans between the trigger 30 and the tip end of the housing 21. The tightening mechanism 40 has a tightening lever 41, a trigger link 42, a link bar 43, a rear chuck bar 44, a front chuck bar 45 and a chuck 46.

The tightening lever 41 has left and right plate parts 51 and a connecting part 52 which connects the left and right plate parts 51. The tightening lever 41 is disposed such that the front/rear intermediate part of the left and right plate parts 51 is positioned between the trigger 30 and the left and right extending parts 32 and such that the connecting part 52 is positioned forward of the left and right extending parts 32. The left and right plate parts 51 are supported such that they can rotate on the bush 35 at each top end.

On the lower part of each of the left and right plate parts 51, a long hole 53 is provided so as to extend in substantially the vertical direction. In the long hole 53, a first pin 54 is inserted so as to be capable of moving along the lengthwise direction of the long hole 53. The first pin 54 is supported on the bottom end of a tension slide 121 to be described later, and is maintained inside the upper part of the long hole 53 during tightening by the tightening mechanism 40 (refer to FIG. 18).

The connecting part 52 extends between the left and right plate parts 51. On the front end of the tightening lever 41 (each front end of the left and right plate parts 51 and/or the connecting part 52), an indentation 55 is provided so as to open substantially forward and upward. The indentation 55 is formed such that it can engage with a switching pin 85. The switching pin 85 can be disengaged from the indentation 55 in response to operation of the trigger 30.

When the trigger 30 is in the non-operating position, the tightening lever 41 is held in the state illustrated in FIG. 5 by the force of a kick spring 56. When the trigger 30 moves from the non-operating position to the operating position, the tightening lever 41 incurs force that counteracts the force of the kick spring 56 via the switching pin 85, and is rotated in the counterclockwise direction in FIG. 5 with the bush 35 as a fulcrum.

The trigger link 42 has left and right plate parts 57 and a connecting part 58 which connects the left and right plate parts 57. The trigger link 42 is disposed such that the front part of the left and right plate parts 57, respectively, and the connecting part 58 are positioned between the left and right plate parts 51 of the tightening lever 41. The left and right plate parts 57 are supported such that they can rotate on the bush 35 at each top end.

On each of the lower parts of the left and right plate parts 57, an indentation 59 is provided so as to open downward. The first pin 54, which protrudes from the long hole 53 in the tightening lever 41, can engage with the indentation 59. The trigger link 42 can rotate integrally with the tightening lever 41 with the bush 35 as a fulcrum by engagement with the first pin 54.

The link bar 43 has an elongated shape and is provided on the rear side of the trigger link 42. The link bar 43 is connected such that it can rotate via a second pin 61 to the rear bottom end of the left and right plate parts 57 of the trigger link 42 at one end (front bottom end) in the lengthwise direction. The link bar 43 is disposed so as to extend rearward and upward from the connecting portion with the trigger link 42.

The rear chuck bar 44 extends in the forward/rearward direction and is connected via a third pin 62 to the other end (rear top end) of the link bar 43 in the lengthwise direction at one end (rear end) in the lengthwise direction. On each of the two ends of the third pin 62 in the lengthwise direction, a cylindrical body 63 is externally fitted. The cylindrical body 63 is supported such that it can move back and forth in the forward/rearward direction in a guide channel 64 provided on the inner surface side of the housing 21.

The front chuck bar 45 extends in the forward/rearward direction and is connected via a fourth pin 65 to the other end (front end) of the rear chuck bar 44 in the lengthwise direction at one end (rear end) in the lengthwise direction. The front chuck bar 45 is disposed so as to extend forward from the connecting portion with the rear chuck bar 44, such that the other end (front end) is positioned rearward of the setting part 23.

The front chuck bar 45 is configured such that it can move back and forth in the forward/rearward direction integrally with the rear chuck bar 44. That is, the front chuck bar 45 is configured such that it moves rearward along the guide channel 64 integrally with rearward movement of the rear chuck bar 44, and moves forward along the guide channel 64 integrally with forward movement of the rear chuck bar 44.

Figure 9:
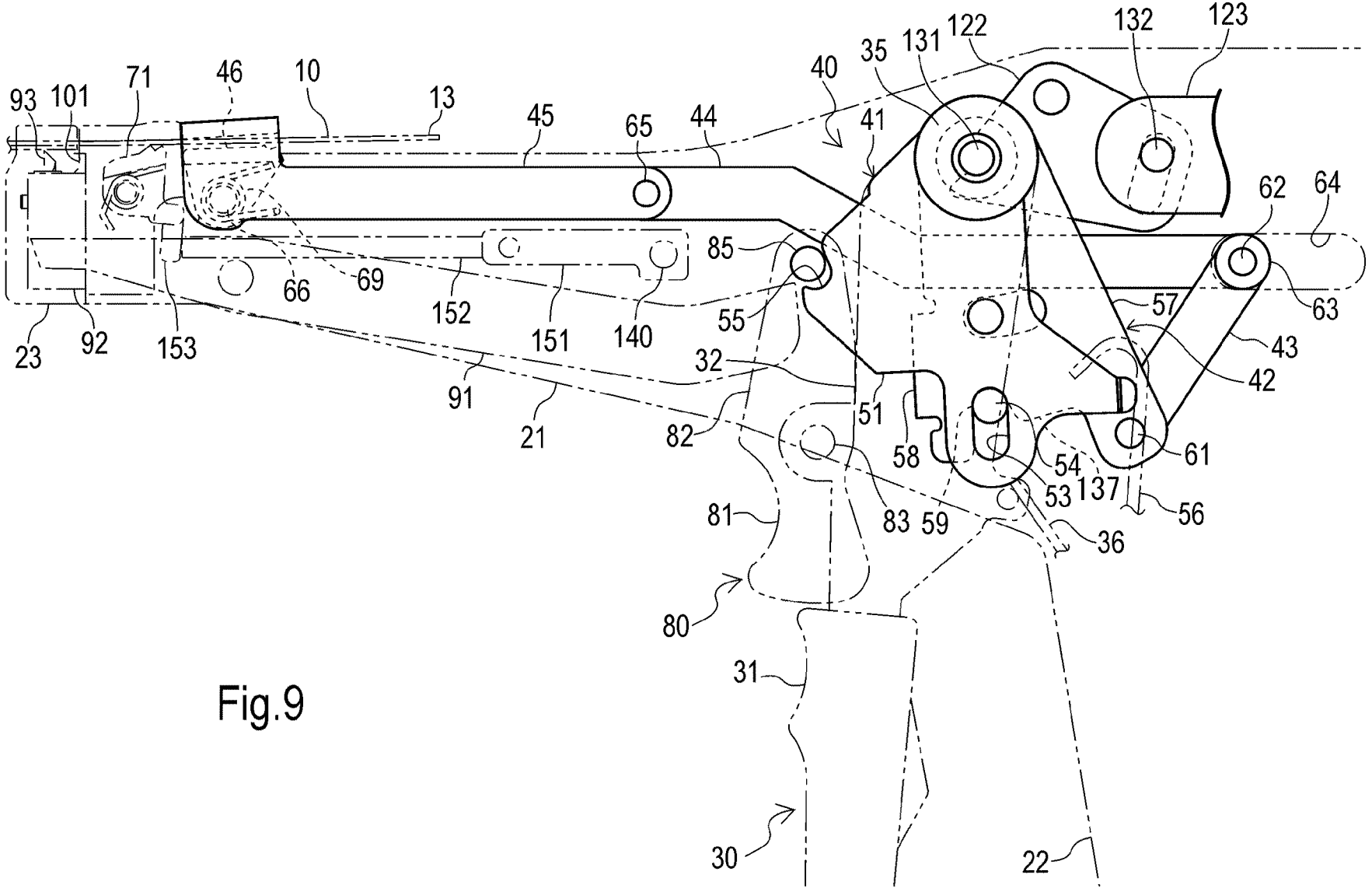
FIG. 9 is a side view of the case where the tightening mechanism of FIG. 8 is in the first state.
Figure 11:
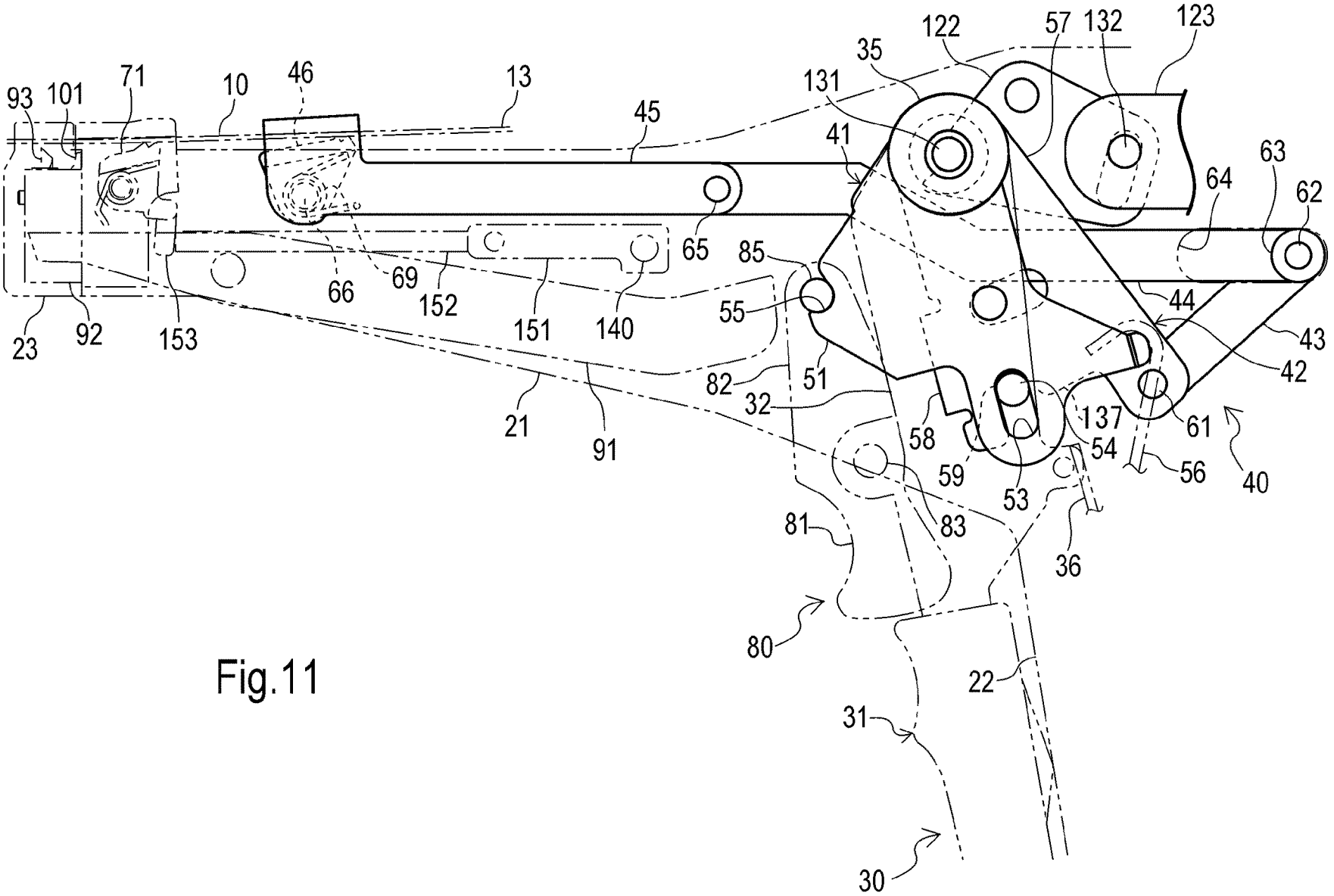
FIG. 11 is a side view of the case where the tightening mechanism of FIG. 8 is in the second state.
Figure 12:
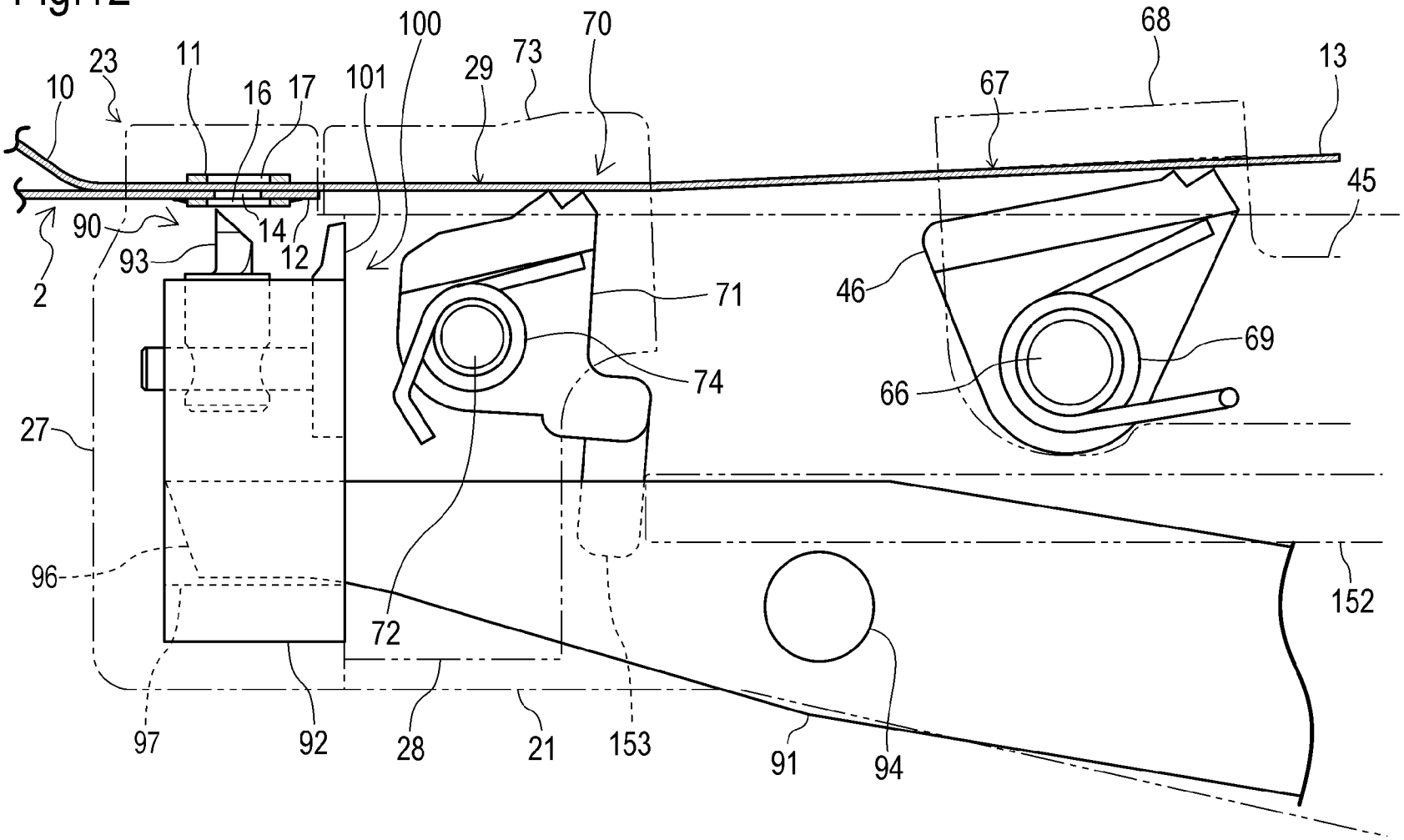
FIG. 12 is a partially enlarged view of FIG. 11.

When the front chuck bar 45 is positioned at the front-most side, the front end of the front chuck bar 45 becomes positioned immediately rearward of the setting part 23 (the guide part 28), as illustrated in FIGS. 5 and 9. When the front chuck bar 45 is positioned at the rear-most side, the front end of the front chuck bar 45 becomes separated from the setting part 23 by a prescribed amount in the rearward direction, as illustrated in FIG. 11.

Figure 10:
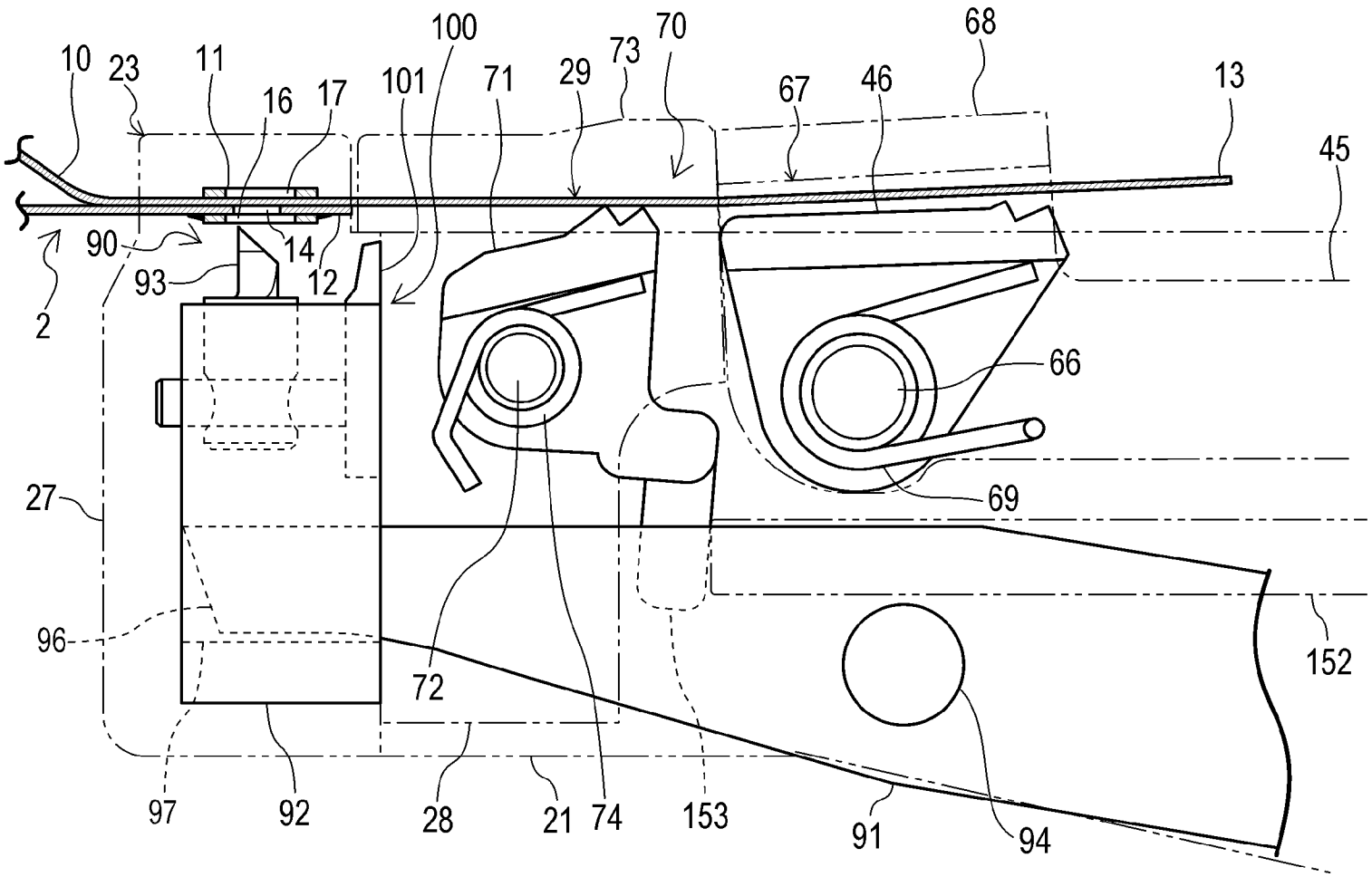
FIG. 10 is a partially enlarged view of FIG. 9.

The chuck 46 is supported via a fifth pin 66 such that it can rotate on the front end of the front chuck bar 45. As illustrated in FIG. 10, the chuck 46 is disposed at a position opposing the front top end 68 of the front chuck bar 45 such that a rear passage route 67, which allows the tip end 13 side of the band part 10 to pass through after it passes through the front passage route 29, is formed inside the front end of the front chuck bar 45.

On the chuck 46, a hook which faces the rear passage route 67 is provided on the rear top end. The chuck 46 is biased so as to rotate in the counterclockwise direction in FIG. 10 by a kick spring 69 in order to catch, using the hook of the chuck 46, a portion of the tip end 13 side of the band part 10 passing through the rear passage route 67, by operating in conjunction with the front top end 68 of the front chuck bar 45.

Thus, when the chuck 46 catches a portion of the tip end 13 side of the band part 10, the tip end 13 side of the band part 10 is prevented from returning toward the direction (forward direction) that passes through the rear passage route 67, and also, the tip end 13 side of the band part 10 is permitted to move in the direction (rearward direction) opposite the direction that passes through the rear passage route 67.

Note that, as illustrated in FIG. 10, when the front end of the front chuck bar 45 is at the forward-most position—that is, immediately rearward of the setting part 23—the chuck 46 hits the setting part 23 (guide part 28) so as to rotate against the force of the kick spring 69, and frees the rear passage route 67 so that the tip end 13 side of the band part 10 can move.

The manual bundling tool 1 also has a holding mechanism 70. The holding mechanism 70 is configured so that it can hold the tip end 13 side of the band part 10 pulled by the tightening mechanism 40, on the tool body 20 such that it cannot return toward the head part 11 (forward) that is set in the setting part 23. In the present embodiment, the holding mechanism 70 has a non-return chuck 71.

The non-return chuck 71 is supported via a sixth chuck pin 72 such that it can rotate in the guide part 28 of the setting part 23. As illustrated in FIG. 10, the non-return chuck 71 is provided forward of the chuck 46, and is disposed at a position opposing the top end 73 of the guide part 28 such that a front passage route 29, which can be disposed continuous with the rear passage route 67, is formed inside the guide part 28.

On the non-return chuck 71, a hook which faces the front passage route 29 is provided on the rear top end. The non-return chuck 71 is biased so as to rotate in the counterclockwise direction in FIG. 10 by a kick spring 74 in order to catch, using the hook of the non-return chuck 71, a portion of the tip end 13 side of the band part 10 passing through the front passage route 29, by operating in conjunction with the top end 73 of the guide part 28.

Thus, when the non-return chuck 71 catches a portion of the tip end 13 side of the band part 10, the tip end 13 side of the band part 10 is prevented from moving in the direction (forward direction) that passes through the front passage route 29, and also, the tip end 13 side of the band part 10 is permitted to move in the direction (rearward direction) opposite the direction that passes through the front passage route 29.

Figure 13:
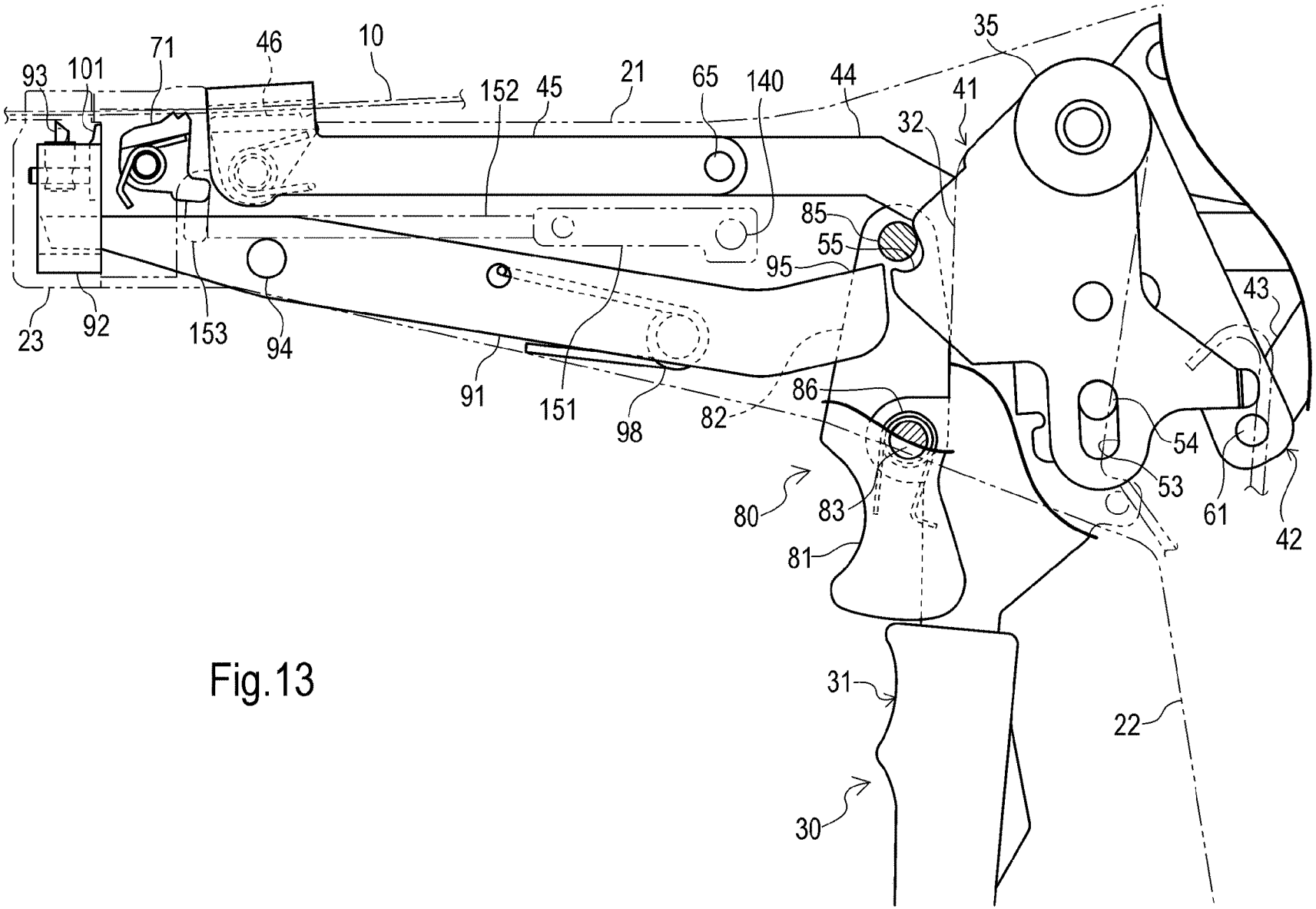
FIG. 13 is a side view of the case where the securing mechanism and the disconnect mechanism in the manual bundling tool of FIG. 1 are each in the first state.

As illustrated in FIG. 13 as well, the manual bundling tool 1 has a second operating means. The second operating means is capable of positional shift relative to the tool body 20. In the present embodiment, the second operating means is configured using the trigger 30 and a switching lever 80 as a switching operation means which is capable of a manual positional shift operation (rotation operation). The switching lever 80 is supported on the trigger 30.

The switching lever 80 is for switching the mechanism that operates in response to a positional shift of the trigger 30, between the tightening mechanism 40 and a securing mechanism 90 to be described later (in the present embodiment, the securing means 90 and the disconnect means 100). The switching lever 80 is mounted on the trigger 30 to enable positional shift integrally with the trigger 30 and to enable positional shift relative to the trigger 30 when it positionally shifts.

In further detail, the switching lever 80 has a second operating part 81 and left and right extending parts 82 which extend from the second operating part 81. The switching lever 80 is provided on the front side of the trigger 30, extending in the substantially vertical direction. The second operating part 81 is disposed beneath the housing 21, and the left and right extending parts 82 are disposed inside the housing 21.

The switching lever 80 is connected via a seventh pin 83 to the vertical intermediate part of the trigger 30 such that it can rotate at the vertical intermediate part of the switching lever 80. Additionally, in the switching lever 80, the switching pin 85 extends between the top ends of the left and right extending parts 82 so as to be capable of positional shift in response to operation of the switching lever 80 and/or the trigger 30.

Figure 14:
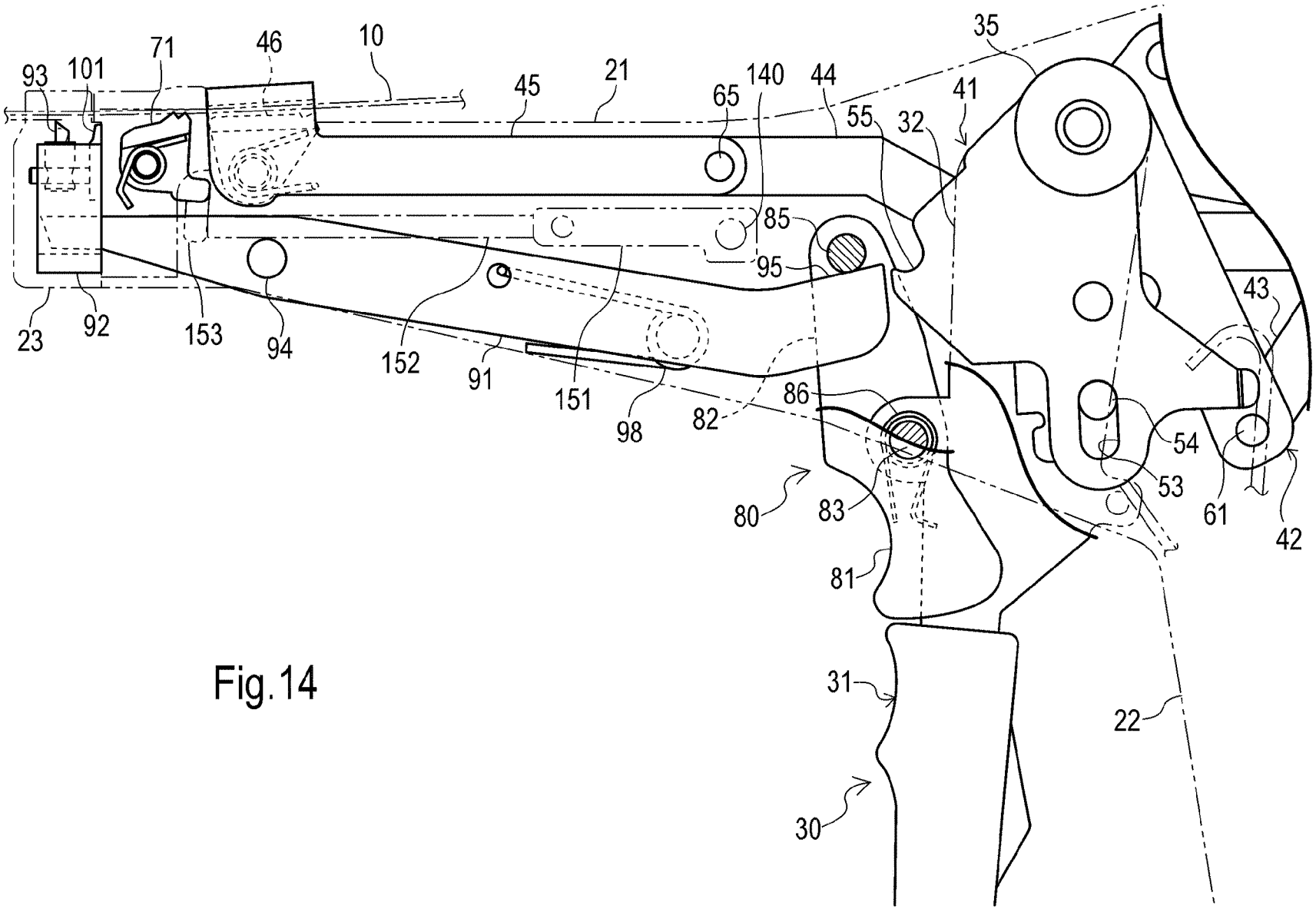
FIG. 14 is a side view of the case where the securing mechanism and the disconnect mechanism in the manual bundling tool of FIG. 13 are each in the second state.
Figure 15:
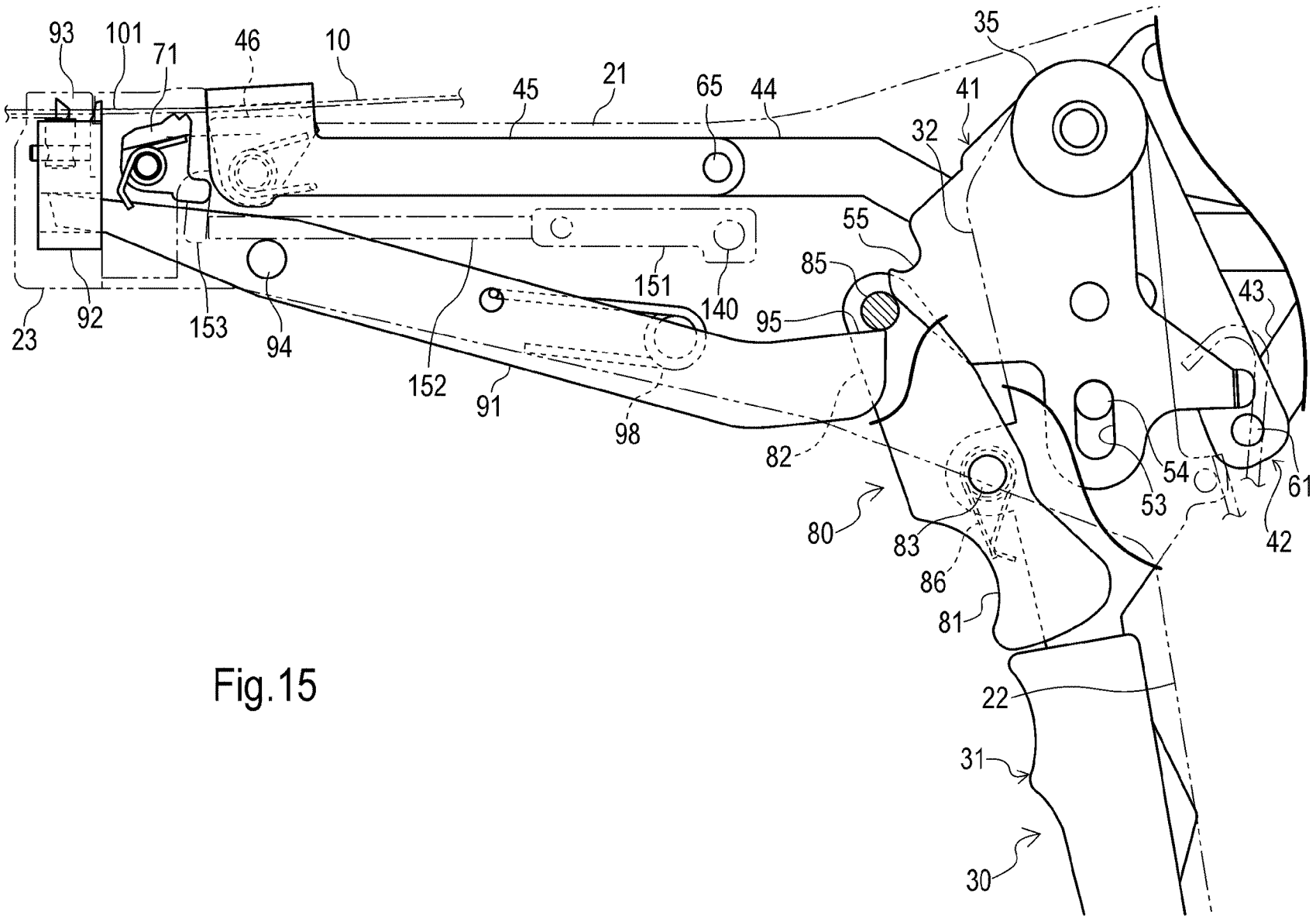
FIG. 15 is a side view of the case where the securing mechanism and the disconnect mechanism in the manual bundling tool of FIG. 13 are each in the third state.

The switching lever 80 is configured such that it can take a first switching operating position at which the second operating part 81 does not positionally shift relative to the trigger 30 (refer to FIGS. 5 and 13) and a second switching operating position at which the second operating part 81 does positionally shift relative to the trigger 30 (refer to FIGS. 14 and 15). When not operated, the switching lever 80 is held at the first switching operating position by the force of a kick spring 86.

On the other hand, when the switching lever 80 is operated against the force of the kick spring 86, it is rotated in the counterclockwise direction in FIG. 13 with the seventh pin 83 as a fulcrum so that it takes the second switching operating position. When this operation of the switching lever 80 ends, the switching lever 80 is rotated by the force of the kick spring 86 so as to return to the first switching operating position.

When the switching lever 80 is positionally shifted together with the trigger 30 while at the first switching operating position, it causes the switching pin 85 to engage with the indentation 55 of the tightening lever 41 (refer to FIG. 11). When the switching lever 80 is operated against the force of the kick spring 86 while the trigger 30 is at the non-operating position, it causes the switching pin 85 to engage with a punch lever 91 to be described later (refer to FIG. 14).

The manual bundling tool 1 is equipped with the securing mechanism 90. The securing mechanism 90 is configured so as to be capable of securing, using the head part 11, a portion of the tip end 13 side of the band part 10 passing through the head part 11 set in the setting part 23, to the base end 12 of the band part 10 in response to respective positional shift operations of the switching lever 80 and the trigger 30.

The securing mechanism 90 is provided mainly inside the front part of the housing 21 of the tool body 20, spanning between the switching lever 80 and trigger 30 and the setting part 23. The securing mechanism 90 can operate alternatively with the tightening mechanism 40 through the switching action of the switching lever 80. It has a punch lever 91, a holder 92 and a punch 93.

The punch lever 91 is provided so as to extend in the forward/rearward direction, and has a curved shape which is convex downward. The punch lever 91 is disposed at a position lower than the front chuck bar 45, and is supported on the front part of the housing 21 via an eighth pin 94 such that it can rotate at the front/rear intermediate part. The eighth pin 94 is disposed forward of the curved portion of the punch lever 91.

A rear end 95 of the punch lever 91 is disposed beneath the switching pin 85 such that it can engage from below with the switching pin 85 provided on the switching lever 80. A front end 96 of the punch lever 91 is inserted in an insertion hole 97 of the holder 92 so as to engage with the holder 92 disposed inside the fitting part 27 of the setting part 23 (refer to FIGS. 7 and 10).

When the switching lever 80 is at the first switching operating position, the punch lever 91 is held by the force of a kick spring 98 so as to engage with the switching pin 85 (refer to FIG. 13). When the switching lever 80 is at the second switching operating position, if the punch lever 91 incurs force that counteracts the force of the kick spring 98 via the switching pin 85, it is rotated so as to engage with the switching pin 85 (refer to FIG. 14).

After engagement with the switching pin 85, if the switching lever 80 is operated together with the trigger 30, the punch lever 91 is rotated in the clockwise direction in FIG. 13 with the eighth pin 94 as a fulcrum (refer to FIG. 15). Note that the punch lever 91 cannot engage with the switching pin 85 unless the trigger 30 is at the non-operating position when the switching lever 80 moves to the second switching operating position.

The holder 92 is provided on the fitting part 27. The holder 92 has the insertion hole 97, which penetrates through the holder 92 in the forward/rearward direction, and is integrally connected with the front end 96 of the punch lever 91 inserted in the insertion hole 97. When the front end 96 is inserted into the insertion hole 97, the holder 92 can be positionally shifted in the vertical direction in response to rotation of the punch lever 91.

The punch 93 projects upward from the top face of the holder 92 so as to positionally shift in the vertical direction together with the holder 92. The punch 93 has a pointed protruding end formed so as to taper in the upward direction, and can pass from this protruding end through the through-hole 14 of the band part 10 and the first opening part 16 and the second opening part 17 of the head part 11.

Figure 16:
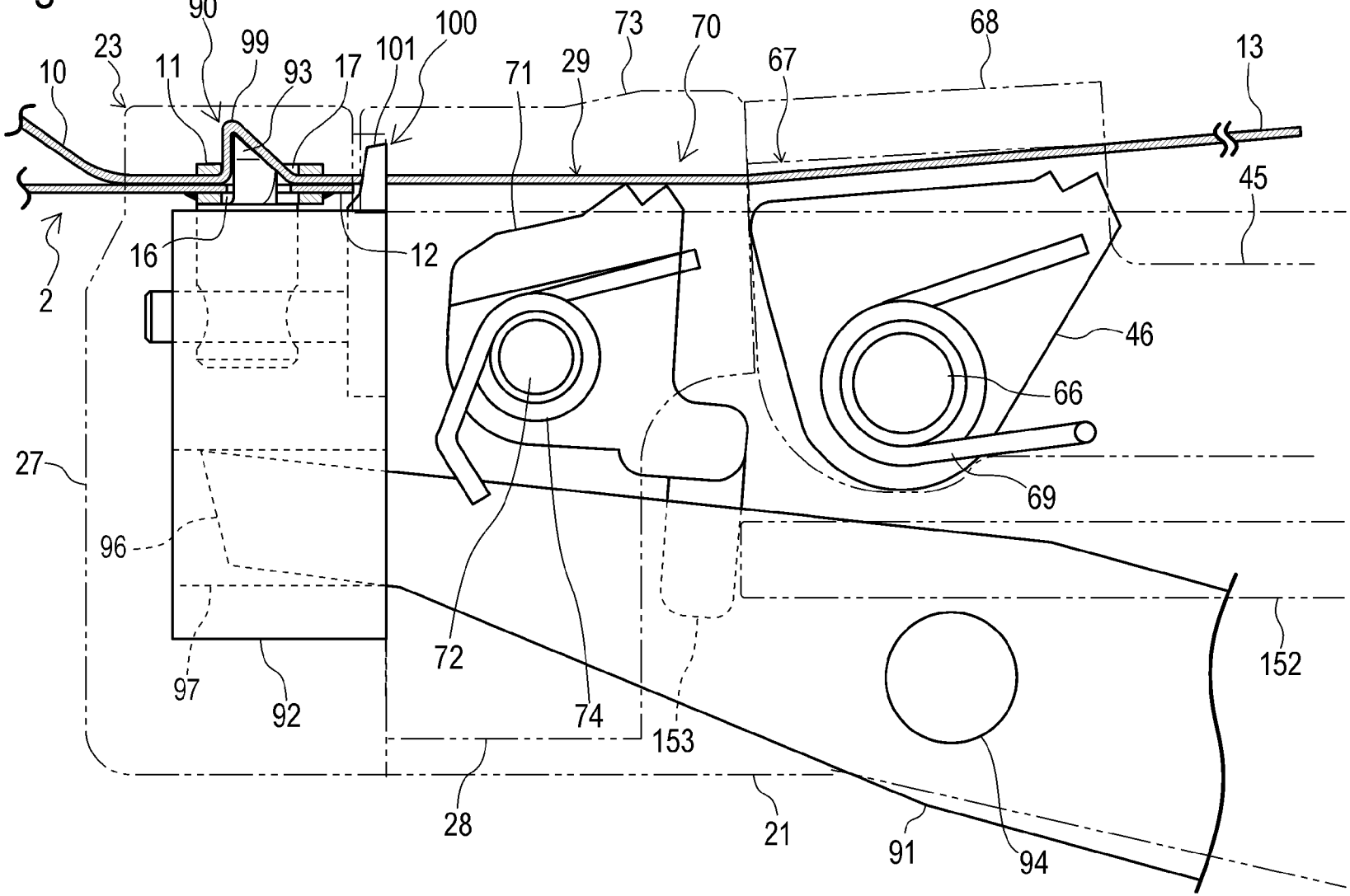
FIG. 16 is a partially enlarged view of FIG. 15.

The punch 93 can take a non-deforming position at which it does not inhibit setting of the head part 11 in the setting part 23 (refer to FIG. 13), or a deforming position at which it passes through the first opening part 16, the through-hole 14 and the second opening part 17 in that order to plastically deform a portion of the tip end 13 side of the band part 10 inside the head part 11 set in the setting part 23, into a convex part 99 (refer to FIGS. 15 and 16).

The convex part 99 formed on the tip end 13 side of the band part 10 engages with the inner face of the second opening part 17 of the head part 11 in the lengthwise direction (forward/rearward direction) of the band part 10. As a result, in the state where the cable tie 2 has appropriately tightened the bundled objects 3, the tip end 13 side of the band part 10 can be secured on the base end 12 side thereof using the head part 11.

The manual bundling tool 1 also has a release operation means. The release operation means is capable of positional shift relative to the tool body 20. In the present embodiment, the release operation means is a release pin 140 capable of manual operation. The release pin 140 is disposed extending in the left/right direction such that one end side in the lengthwise direction (left end side) passes through a long hole 141 in the housing 21 (refer to FIGS. 1 and 2).

The release pin 140 is provided such that it is capable of positional shift relative to the housing 21 in the forward/rearward direction along the long hole 141. The release pin 140, which can take a non-operating position located at the rear side of the long hole 141 or an operating position located closer to the front side of the long hole 141 than the non-operating position, is held in a state where it is exposed outside the housing 21.

Figure 17:
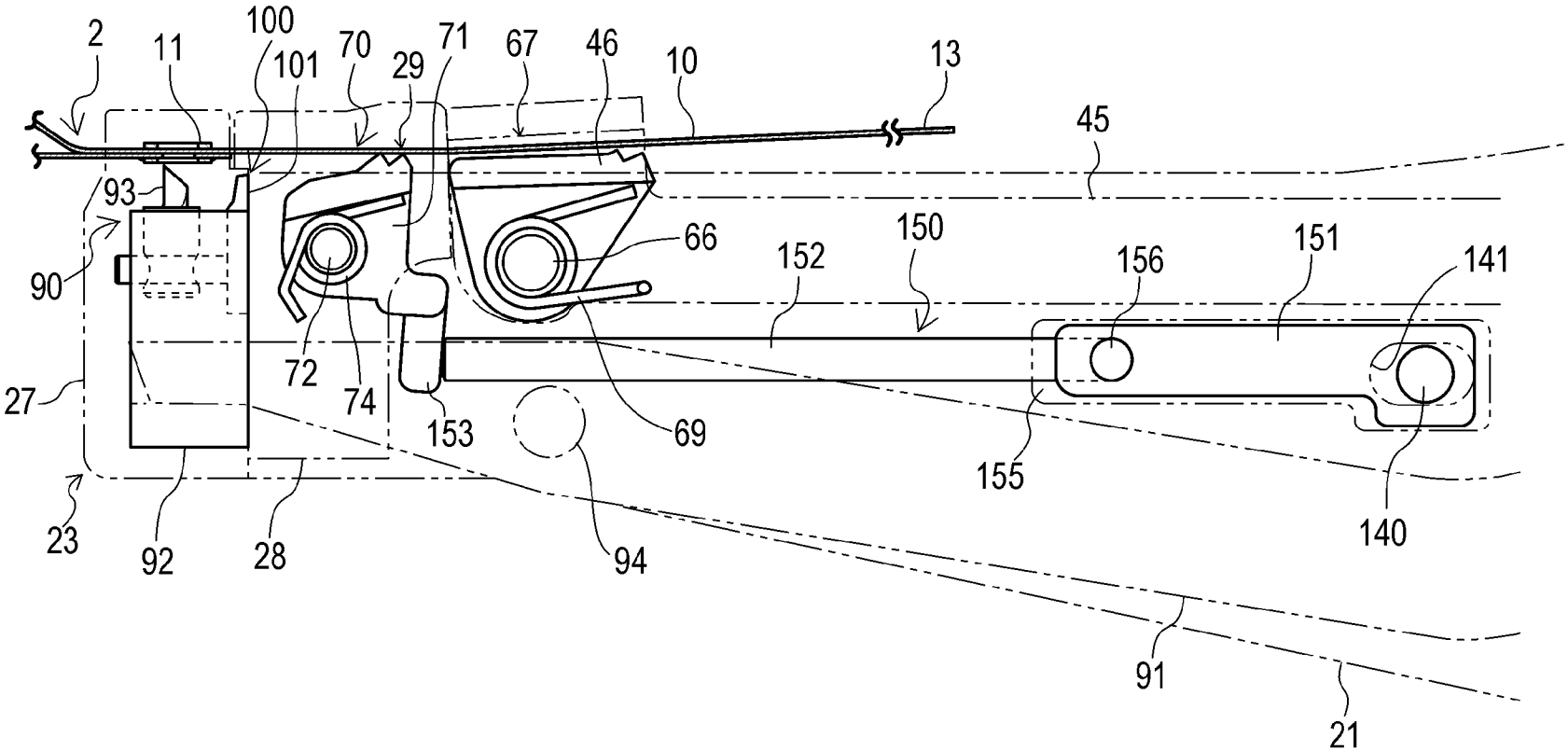
FIG. 17 is a side view of the case where the release mechanism in the manual bundling tool of FIG. 1 is in the first state.
Figure 18:
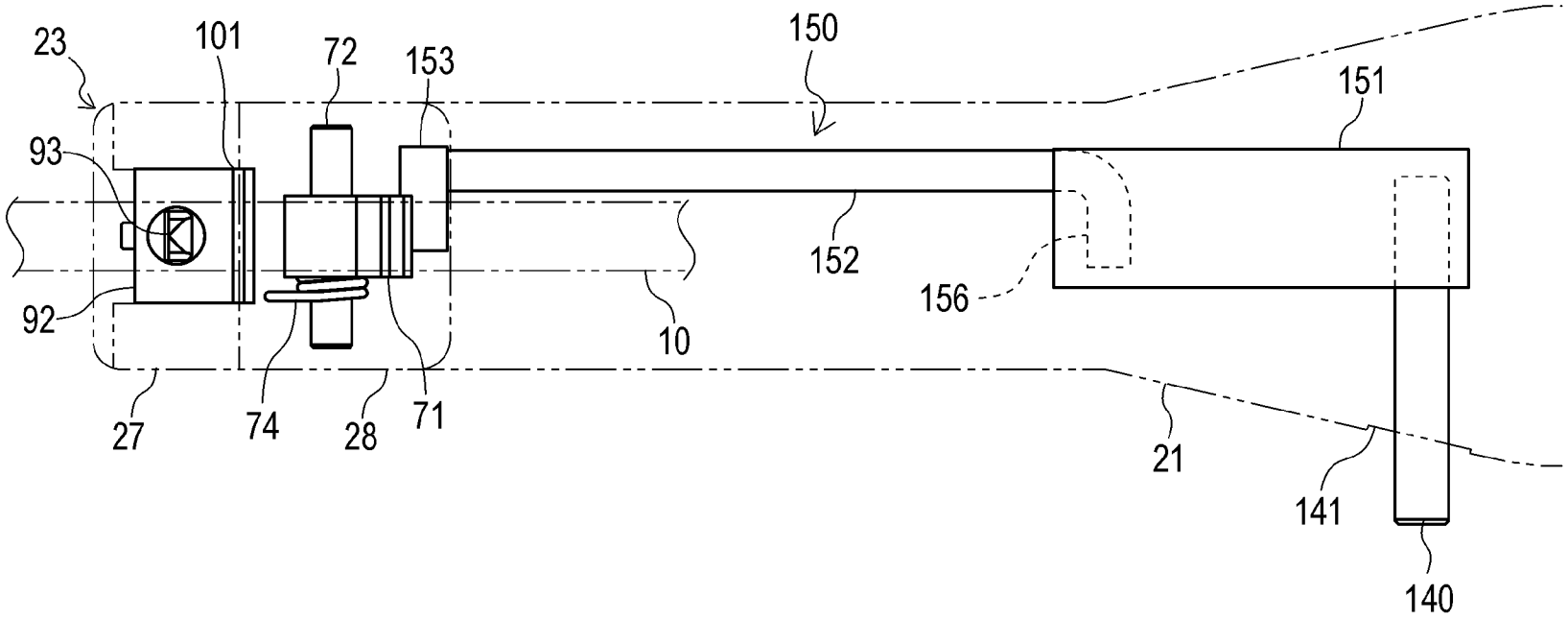
FIG. 18 is a plan view of the release mechanism of FIG. 17.

In the present embodiment, the manual bundling tool 1 also has a release mechanism 150. The release mechanism 150 is configured so as to be capable of releasing the hold on the band part 10 of the cable tie 2 by the holding mechanism 70 in response to a positional shift of the release pin 140. As illustrated in FIGS. 17 and 18, the release mechanism 150 has a moving body 151, a depressing body 152 and a connecting body 153.

The moving body 151 is disposed rearward of the holding mechanism 70 (the non-return chuck 71), extending in the forward/rearward direction. The moving body 151 is supported on the housing 21 such that it can move back and forth in the forward/rearward direction along a guide channel 155 provided on the inner face of the housing 21. The other end side (right end side) of the release pin 140 in the lengthwise direction is secured to the rear part of the moving body 151.

The depressing body 152 extends in the forward/rearward direction and consists of a rod-shaped member. The depressing body 152 is disposed such that it can move back and forth in the forward/rearward direction between the moving body 151 and the non-return chuck 71. A curved part 156 is provided on the rear end of the depressing body 152. The depressing body 152 is integrally connected with the moving body 151 via the curved part 156.

The connecting body 153 is disposed forward of the depressing body 152. The connecting body 153 is provided integrally with the non-return chuck 71 so as to operate in connection with the non-return chuck 71. The connecting body 153 has a contact face which faces the front end of the depressing body 152, and is able to contact the front end of the depressing body 152 by this contact face.

As illustrated in FIGS. 17 and 18, the release mechanism 150 is configured such that the front end of the depressing body 152 abuts (or is separated from) the connecting body 153 when the release pin 140 is at the non-operating position. For this reason, the action of the holding mechanism 70 (action such that the non-return chuck 71 captures the tip end 13 side of the band part 10) is completed without hindrance by the release mechanism 150.

Figure 19:
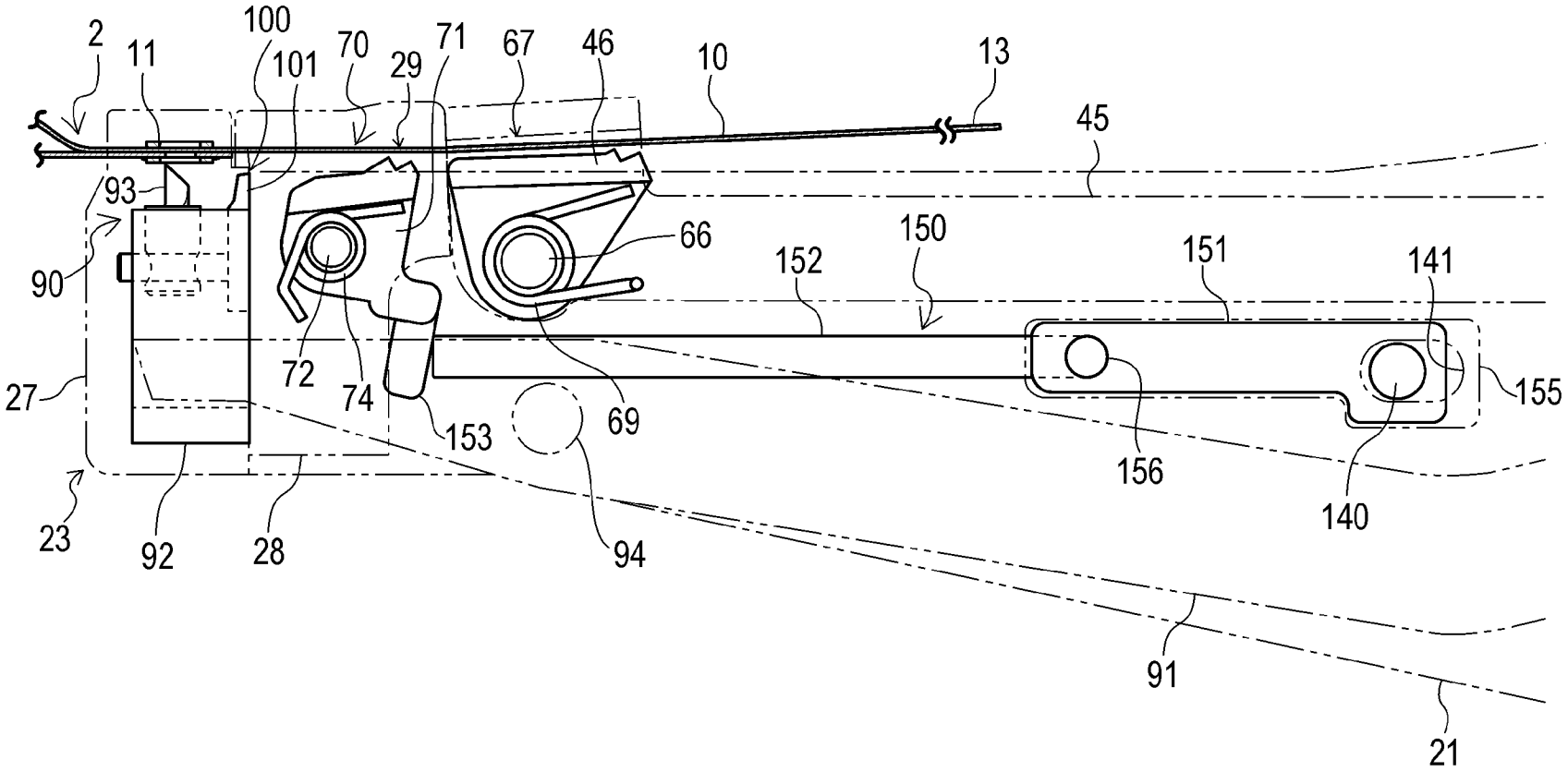
FIG. 19 is a side view of the case where the release mechanism of FIG. 17 is in the second state.

As illustrated in FIG. 19, the release mechanism 150 is configured such that when the release pin 140 is positionally shifted to the release operating position, the depressing body 152 depresses the connecting body 153 such that the non-return chuck 71 rotates in the clockwise direction in FIG. 17. For this reason, in this case, the release mechanism 150 changes the front passage route 29 to the free state so that the tip end 13 side of the band part 10 can move.

When such operation of the release pin 140 ends, the release pin 140 is moved backward in FIG. 19 by the force of the kick spring 74 such that it returns to the non-release operating position. Note that to avoid faulty operation as much as possible, the release pin 140 projects in a direction (leftward) that differs from the protrusion direction (downward) of the trigger 30 relative to the housing 21.

Therefore, if the tip end 13 side of the band part 10 is held by the holding mechanism 70 in the state where the head part 11 of the cable tie 2 has been set in the setting part 23 of the tool body 20, the tip end 13 side of the band part 10 is released from the holding mechanism 70 using the release mechanism 150, and can be moved in any direction (forward or rearward) relative to the tool body 20.

Thus, after the cable tie 2 is mounted on the manual bundling tool 1, if the position of tightening with the cable tie 2 is wrong or the bundled objects are insufficient, the entire cable tie 2 is removed from the manual bundling tool 1 and the tip end 13 side of the band part 10 is returned to the head part 11, and the operations on the cable tie 2 can be redone quickly and easily.

The following is a description of an example of the method of performing the bundling operation using the manual bundling tool 1 with the cable tie 2 for bundling the bundled objects 3.

First, a preprocessing step is performed for mounting the cable tie 2 on the manual bundling tool 1 and the bundled objects 3. Specifically, the band part 10 of the cable tie 2 is wrapped around the bundled objects 3. Then, the head part 11 of the cable tie 2 is set in the setting part 23 (the fitting part 27) of the tool body 20 in the manual bundling tool 1.

The band part 10 is passed from the tip end 13 side thereof through a through-hole 15 of the head part 11, the front passage route 29 in the manual bundling tool 1, and the rear passage route 67 in that order, and the tip end 13 side of the band part 10 is maintained in a state where it is held by the holding mechanism 70. Note that in the preprocessing step, if the operations on the cable tie 2 must be redone, they are performed using the release mechanism 150.

Then, to temporarily tighten the cable tie 2, the tip end 13 side of the band part 10 after passing through the rear passage route 67 is pulled by a manual operation toward the direction (rearward) away from the head part 11. At this time, the movement of the tip end 13 side of the band part 10 is as described above, and is not hindered by the non-return chuck 71 in the holding mechanism 70 or the chuck 46 in the tightening mechanism 40.

After the preprocessing step, a tightening step is performed, wherein the band part 10 is pulled until the cable tie 2 reaches the desired state of tightening for the bundled objects 3 using the tightening mechanism 40 of the manual bundling tool 1. Specifically, the handle 22 of the tool body 20 and the trigger 30 are grasped, and the trigger 30 is operated so as to positionally shift from the non-operating position illustrated in FIG. 9 to the operating position illustrated in FIG. 11.

During this operation, since the switching lever 80 positionally shifts together with the trigger 30 at the first switching operating position as is, the switching pin 85 first positionally shifts rearward so as to engage with the indentation 55 and then positionally further shifts rearward in the state where it is engaged with the indentation 55. For this reason, the tightening lever 41 is pressed by the switching pin 85 and rotates counterclockwise in FIG. 9 with the bush 35 as a fulcrum.

By rotation of the tightening lever 41, the first pin 54 inserted in the long hole 53 positionally shifts rearward. Due to the fact that the first pin 54 is engaged with the indentation 59, the trigger link 42 is pressed by the first pin 54 and rotates in the counterclockwise direction in FIG. 9 with the bush 35 as a fulcrum. For this reason, the link bar 43 positionally shifts so as to move the rear top end rearward along the guide channel 64.

The rear chuck bar 44 moves rearward due to the positional shift of the link bar 43. The front chuck bar 45 moves rearward accordingly. Therefore, the chuck 46 first starts to move rearward so as to separate from the setting part 23 to capture the tip end 13 side of the band part 10 in the rear passage route 67, and then moves further rearward in the state where it has captured the tip end 13 side of the band part 10.

Thus, the tightening mechanism 40 is capable of pulling the tip end 13 side of the band part 10 rearward relative to the head part 11 so as to increase the tension of the cable tie 2 by a prescribed amount. After that, the trigger 30 is released to return to its original state. As a result, the tightening mechanism 40 returns to its original state so that it can operate again by the next operation of the trigger 30.

In the tightening step, the trigger 30 is operated as described above at least once until the tension of the cable tie 2 reaches the desired tension. Note that completion of the tightening step (the tension of the cable tie 2 has reached the desired tension) can be judged, for example, by looking at the state of the cable tie 2 or by using a tension adjustment mechanism 120 to be described later.

After completion of the tightening step, a securing step is performed using the securing mechanism 90 to secure the tip end 13 side to the base end 12 of the band part 10. Specifically, first, the handle 22 and the switching lever 80 are grasped while the trigger 30 is in the non-operating position, and the switching lever 80 is operated so as to positionally shift from the first switching operating position illustrated in FIG. 13 to the second switching operating position illustrated in FIG. 14.

Thus, the switching pin 85 is caused to engage with the rear end 95 of the punch lever 91 so that the mechanism that operates in response to positional shift of the trigger 30 is switched. Then, with the switching lever 80 at the second switching operating position, the trigger 30 is again grasped and operated so as to positionally shift to the operating position together with the switching lever 80, as illustrated in FIG. 15.

During this operation, the punch lever 91 is pressed by the switching pin 85 and rotates in the clockwise direction in FIG. 14 with the eighth pin 94 as a fulcrum. For this reason, the holder 92 positionally shifts upward. Therefore, as illustrated in FIGS. 15 and 16, the punch 93 positionally shifts upward so as to deform a portion of the tip end 13 side of the band part 10 inside the head part 11 set in the setting part 23, into the convex part 99.

Therefore, the convex part 99 in the band part 10 engages with the head part 11, and the securing mechanism 90 secures the tip end 13 side of the band part 10 to the base end 12 thereof using the head part 11. After that, the trigger 30 and the switching lever 80 are released to return to their original states. For this reason, the securing mechanism 90 and the disconnect mechanism 100 return to their original states.

After the securing step is completed, the tip end 13 side of the band part 10 is removed from the holding mechanism 70 and so forth and the head part 11 is also removed from the setting part 23 by operation of the release mechanism 150. As a result, the cable tie 2 is removed from the manual bundling tool 1, and the bundling operation using the manual bundling tool 1 is complete.

Based on the above, according to the aforementioned manual bundling tool 1, bundled objects 3 can be bundled with the cable tie 2 having a desired tension. Moreover, if a problem is discovered after the cable tie 2 has been mounted on the manual bundling tool 1, the operations on the cable tie 2 can be redone quickly and easily. Thus, the convenience of the bundling operation can be improved.

In the present embodiment, the tool body 20 has a pistol shape and the setting part 23 is disposed in a region equivalent to the muzzle portion of the tool body 20. In other words, the setting part 23 is provided on a relatively narrow front end (tip end) on the tool body 20, and is configured such that the band part 10 can be extended from the head part 11 set in the setting part 23 during the bundling operation.

Through such a configuration, even when the bundled objects 3 are disposed in a relatively small work space such as a location surrounding by equipment, when the manual bundling tool 1 is used, the setting part 23 (the head part 11) can be easily brought into contact with the bundled objects 3. Therefore, the ease of handling of the manual bundling tool 1 and the cable tie 2 can be improved.

Furthermore, in the present embodiment, the setting part 23 is disposed on the tip end of the housing 21 so as to be positioned on the side (top side) opposite the protrusion direction of the handle 22. As a result, it is possible to prevent the problem that the tip end 13 side of the band part 10 hits the hand that is grasping the trigger 30 when the cable tie 2 has been mounted on the manual bundling tool 1 and the band part 10 is pulled.

Figure 20A:
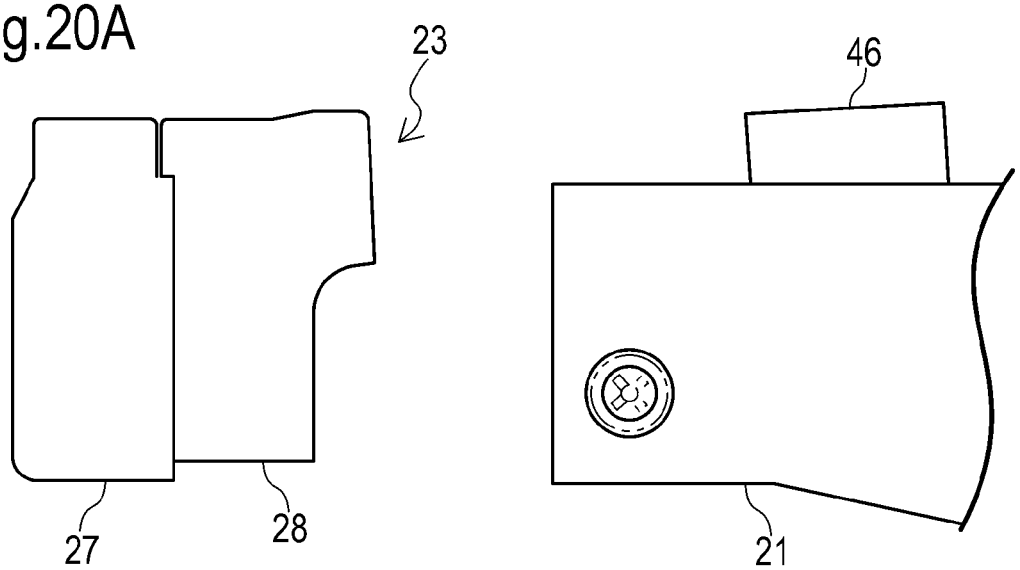
FIG. 20A is a side view illustrating the state where the setting part in the manual bundling tool of FIG. 1 has been removed from the housing.
Figure 20B:
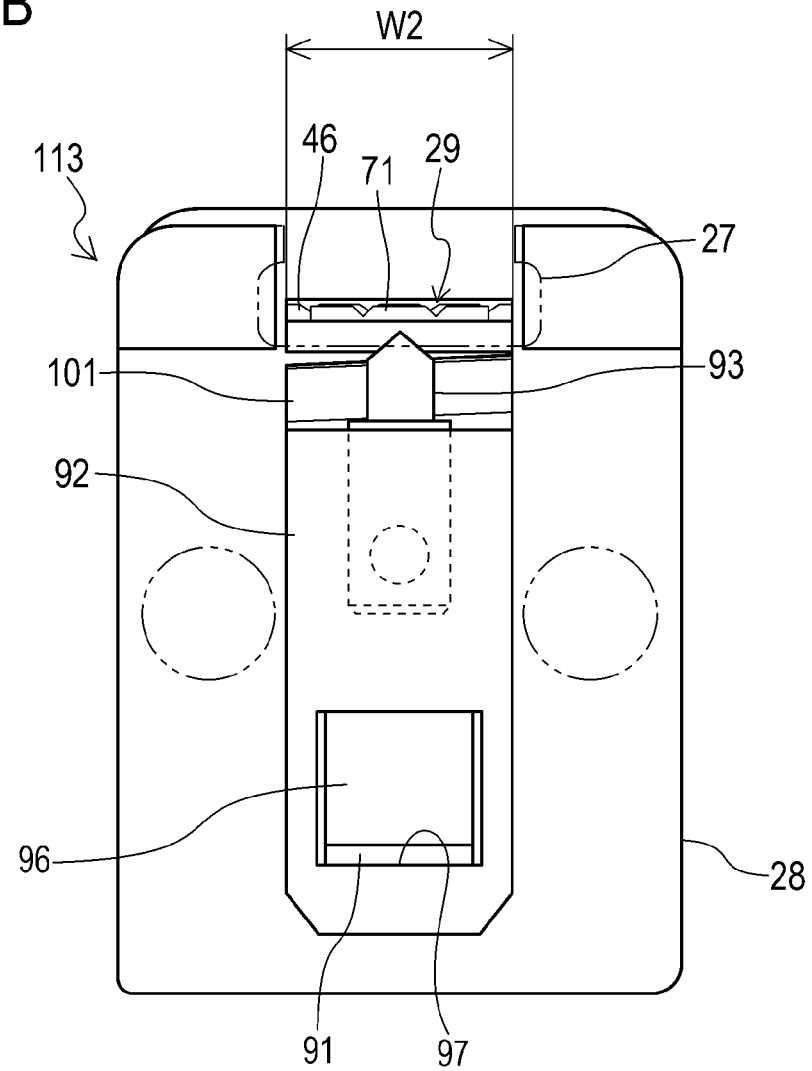
FIG. 20B is a front view of a setting part different from this setting part.

In the present embodiment, as illustrated in FIGS. 2 and 20A, the setting part 23 of the tool body 20 is mounted on the housing 21 such that it can be attached and detached. Therefore, the majority of the manual bundling tool 1 can be used for other cable ties having a band width different from the cable tie 2 simply by replacing the setting part 23 with another setting part 113 containing a front passage route 29 having a width W2 (refer to FIG. 20B).

In other words, when the user wishes to perform a bundling operation using the other cable tie, the manual bundling tool 1 (excluding the setting part 23) can be used simply by exchanging the setting part 23 and the separately prepared other setting part 113. Thus, it is possible for the manual bundling tool 1 to be compatible with various cable ties at low cost without preparing a manual bundling tool (in its entirety) other than the manual bundling tool 1.

In the present embodiment, the switching lever 80 is mounted on the trigger 30 such that it can positionally shift integrally with the trigger 30 relative to the tool body 20 and can positionally shift relative to the trigger 30 such that it can be grasped together with each of the handle 22 and the trigger 30.

Due to this configuration, after the handle 22 and the trigger 30 have been operated in order to operate the tightening mechanism 40, when the mechanism that operates in response to positional shift of the trigger 30 is operated by switching from the tightening mechanism 40 to the securing mechanism 90 and the disconnect mechanism 100, the switching lever 80 is again grasped while still grasping the trigger 30 and without changing the hold on the trigger 30 and so forth, and the switching lever 80 as well as the trigger 30 can be operated. Therefore, the manual bundling tool 1 can be operated quickly and easily.

In the present embodiment, the manual bundling tool 1 has a mechanism that disables switching by the switching lever 80 during positional shift of the trigger 30. Specifically, when the trigger 30 is in the position to which it shifted from the non-operating position due to operation of the tightening mechanism 40, the switching pin 85 cannot engage with the punch lever 91 even when the switching lever 80 is operated.

Due to such a configuration, if the switching lever 80 is unintentionally positionally shifted (for example, if fingers that are not grasping the trigger 30 and the handle 22 end up hitting the switching lever 80 in the tightening step), the securing mechanism 90 and the disconnect mechanism 100 can be prevented from being erroneously operated so that securing and disconnecting related to the band part 10 are not performed.

In the present embodiment, the manual bundling tool 1 has a third operating means. The third operating means is provided such that it can positionally shift relative to the tool body 20. In the present embodiment, the third operating means is the same operating means as the second operating means, consisting of the trigger 30 and the switching lever 80, which is capable of manual positional shift (rotation) operation. In other words, the second operating means also serves as the third operating means.

In the present embodiment, the manual bundling tool 1 is equipped with the disconnect mechanism 100. The disconnect mechanism 100 is capable of disconnecting the tip end 13 side of the band part 10 after passing through the head part 11 set in the setting part 23 to separate it in the lengthwise direction of the band part 10 in response to a positional shift operation of the trigger 30 and the switching lever 80.

The disconnect mechanism 100 is equipped with the punch lever 91, the holder 92, and a cutter blade 101. The cutter blade 101 projects upward from the top face of the holder 92 so as to positionally shift together with the holder 92 in the vertical direction. In other words, the cutter blade 101 can positionally shift in sync with a positional shift of the punch 93.

The cutter blade 101 is disposed rearward of the punch 93. The cutter blade 101 is formed such that when it positionally shifts together with the punch 93 due to the upward positional shift of the holder 92, disconnect of the tip end 13 side of the band part 10 can be completed earlier than when the action of the punch 93 on the tip end 13 side of the band part 10 begins.

The cutter blade 101 can take a non-disconnecting position at which it does not disconnect the tip end 13 side of the band part 10 protruding rearward from the through-hole 15 of the head part 11 set in the setting part 23 toward the front passage route 29 (refer to FIG. 13) or a disconnecting position at which it disconnects the tip end 13 side of the band part 10 between the head part 11 and the holding mechanism 70 (refer to FIGS. 15 and 16).

Due to such a configuration, when the holder 92 positionally shifts upward due to operation of the switching lever 80 and the trigger 30, after securing by the securing mechanism 90 begins, the cutter blade 101 begins positionally shifting upward to split the tip end 13 side of the band part 10 between the non-return chuck 71 and the head part 11 set in the setting part 23.

Therefore, if there is an excess portion of the tip end 13 side of the band part 10, this excess portion can be removed using the disconnect mechanism 100 after completion of the tightening step (the securing step). Note that in the present embodiment, the securing step by the securing mechanism 90 and the disconnect step by the disconnect mechanism 100 can be executed substantially simultaneously through a single operation of the switching lever 80 and the trigger 30.

In the present embodiment, the manual bundling tool 1 is equipped with the tension adjustment mechanism 120. The tension adjustment mechanism 120 is for raising or lowering the maximum tension of the cable tie 2 produced by the tightening mechanism 40. As described above, at completion of the tightening step, disconnect becomes possible based on the maximum value (set value) set by the tension adjustment mechanism 120.

Figure 21:
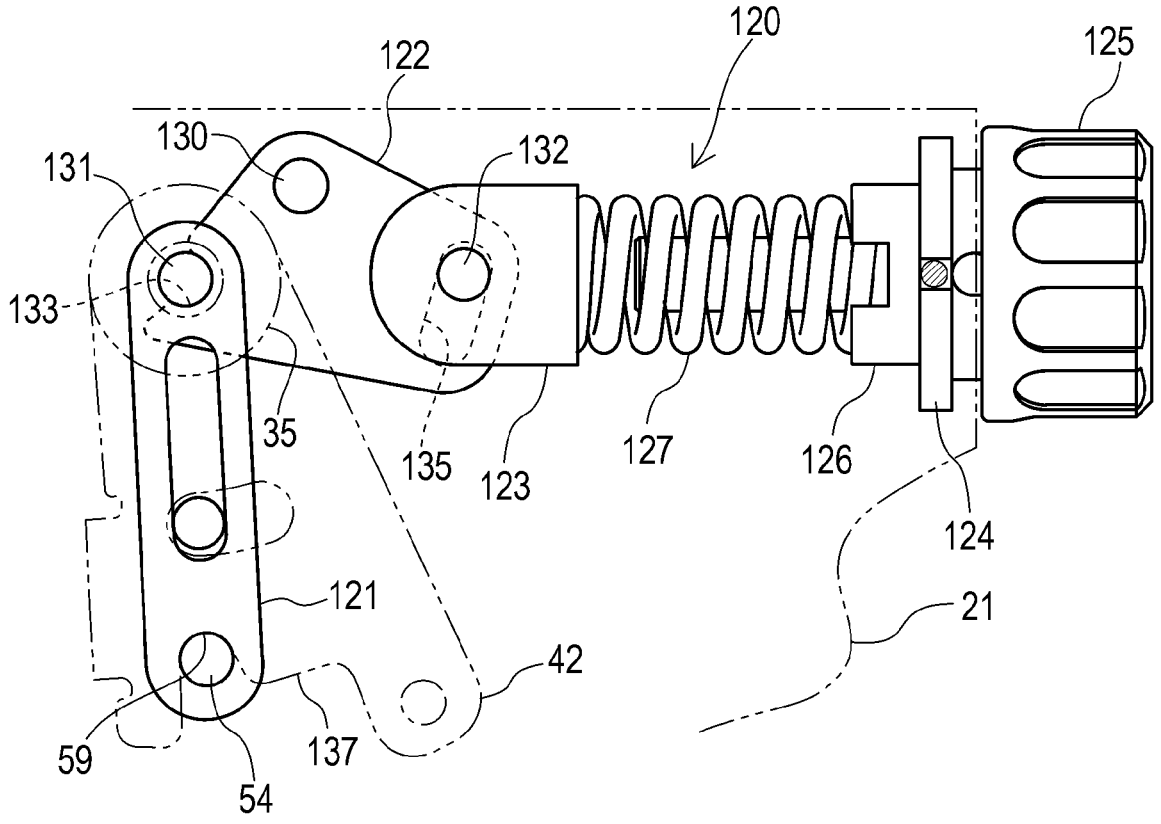
FIG. 21 is a side view of the case where the tension adjustment mechanism in the manual bundling tool of FIG. 1 is in the first state.

As illustrated in FIGS. 5, 6 and 21, the tension adjustment mechanism 120 has a tension slide 121, a tension slew 122, a tension plate 123, a tension base 124, a tension dial 125, a rolling cam 126 and a compression coil spring 127. The tension adjustment mechanism 120 is provided on the rear part of the housing 21.

The tension slide 121 is disposed extending in the vertical direction between the left and right plate parts 57 of the trigger link 42. The bottom end of the tension slide 121 is connected via the first pin 54 to the tightening lever 41 and the trigger link 42, and the top end of the tension slide 121 is connected via a roller pin 131 to the tension slew 122.

The tension slew 122 is disposed on the rear side of the bush 35 and is supported via a ninth pin 130 on the housing 21 such that it can rotate. The front part of the tension slew 122 has an indentation 133 into which the roller pin 131 fits such that it can rotate. On the rear part of the tension slew 122, it has a long hole 135 into which a tenth pin 132 is inserted such that it can move back and forth roughly in the forward/rearward direction.

The tension plate 123 has a U shape. The tension plate 123 is disposed in a state where it sandwiches the tension slew 122 from the left and right such that the blocking part of the tension plate 123 is positioned rearward of the tension slew 122. The tension plate 123 is linked via the ninth pin 130 to the tension slew 122.

The tension base 124 is disposed so as to partition off a prescribed gap rearward of the blocking part of the tension plate 123. On the rear side of the tension base 124, the tension dial 125 is provided so as to be exposed outside the housing 21. On the front side of the tension base 124, the rolling cam 126 is provided such that it can move back and forth in the forward/rearward direction relative to the housing 21.

The tension dial 125 can be held in any of a plurality of rotational states. The rolling cam 126 can be held in a position that is shifted by a prescribed amount in the forward/rearward direction in accordance with the rotational state of the tension dial 125. The compression coil spring 127 is provided between the tension plate 123 and the rolling cam 126 such that the direction of compression is the forward/rearward direction.

Thus, while the tightening mechanism 40 is operating, during the time before the tension of the cable tie 2 reaches the maximum value (set value), the roller pin 131 is pressed by a prescribed force toward the forward side by the tension slew 122 so as to maintain the position thereof, and the tension slide 121 rotates coupled with the tightening lever 41 and the trigger link 42 with the roller pin 131 as a fulcrum.

Figure 22:
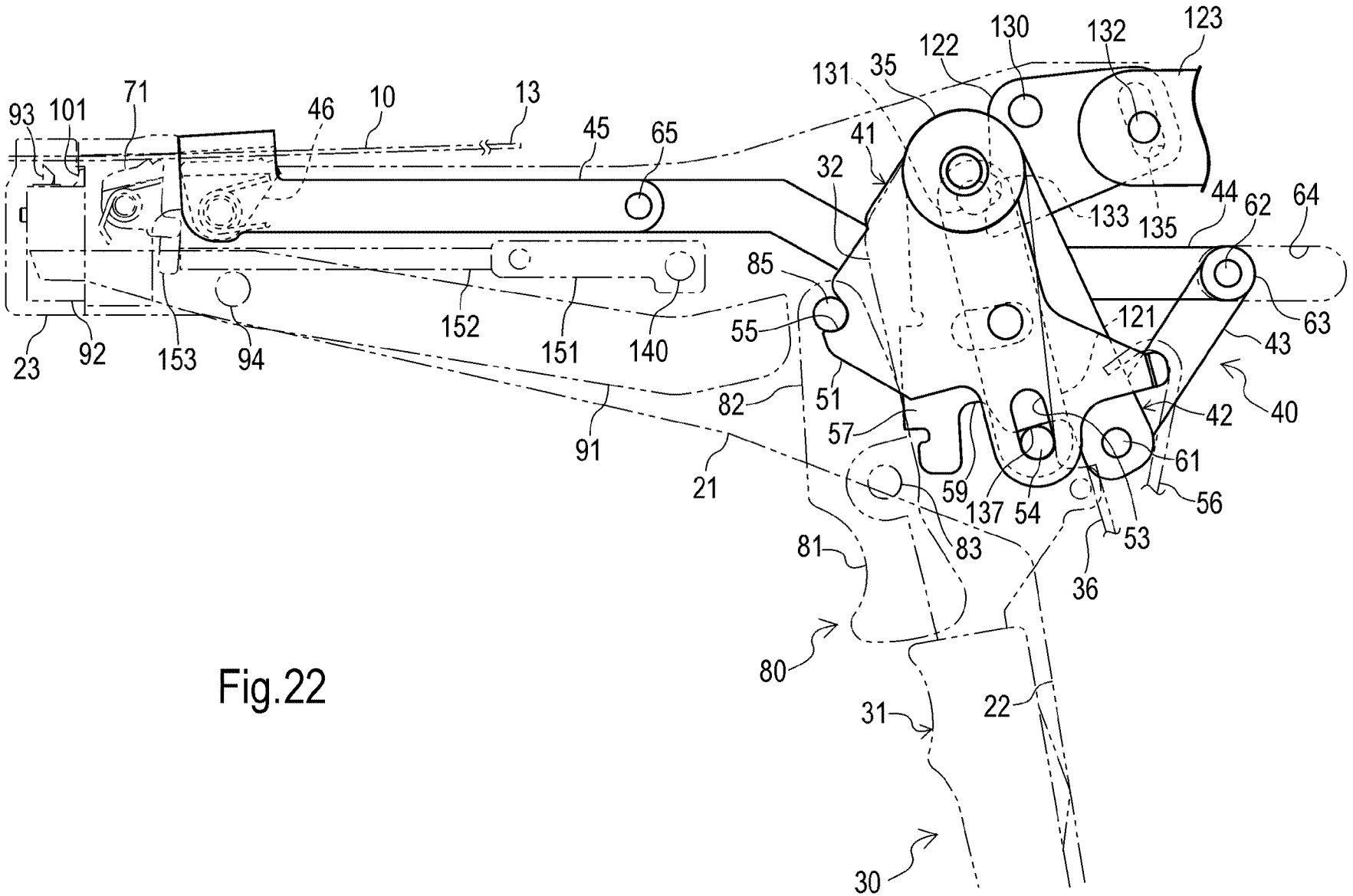
FIG. 22 is a side view of the case where the tension adjustment mechanism of FIG. 21 is in the second state.

If the tension of the cable tie 2 reaches the maximum value, when the trigger 30 is operated, the tension slew 122 rotates such that the tension slide 121 positionally shifts, as illustrated in FIG. 22. At that time, the first pin 54 moves to a step 137 connected to the indentation 59 while moving toward the bottom part of the long hole 53, to release its engagement with the indentation 59 of the trigger link 42.

As a result, the trigger link 42 becomes unlinked from the tightening lever 41. For this reason, the rear chuck bar 44 and the front chuck bar 45 no longer move back and forth even if the tightening lever 41 rotates. Therefore, in this case, although it is possible to positionally shift the trigger 30, the tension of the cable tie 2 cannot be increased by the tightening mechanism 40.

Due to such a configuration, when the tension dial 125 is rotated in either the left or right direction, the compression coil spring 127 is held in a compressed state due to movement of the rolling cam 126, and the tension slew 122 (the roller pin 131) can be pressed with a stronger force. Thus, it can be adjusted in a direction that increases the maximum tension of the cable tie 2 produced by the tightening mechanism 40.

Conversely, if the tension dial 125 is rotated in the other of either the left or right direction, the compression coil spring 127 is held in a stretched state due to movement of the rolling cam 126, and the tension slew 122 (the roller pin 131) can be pressed with a weaker force. Thus, it can be adjusted in a direction that decreases the maximum tension of the cable tie 2 produced by the tightening mechanism 40.

Note that in the present embodiment, the plurality of rotational states related to the tension dial 125 include a prescribed rotational state that has no effect on the operation of the tension adjustment mechanism 120. The above description of the tension adjustment mechanism 120 is for the case where the tension dial 125 is operated to any rotational state excluding the aforementioned prescribed rotational state.

I claim:

1. A manual bundling tool configured for use with a cable tie for bundling bundled objects with the cable tie having a belt-shaped band part and a head part provided on a first end of the band part in a lengthwise direction, the manual bundling tool comprising:

a tool body having a housing, a handle projecting from the housing, and a setting part connected to the housing and formed so as to be configured for setting the head part of the cable tie;

a first operating means configured for positionally shifting relative to the tool body so as to oppose the handle;

a tightening mechanism configured for pulling a second end of the band part, which is opposite the first end of the band part, in the lengthwise direction of the band part after passing through the setting part and in a direction away from the head part in response to positionally shifting the first operating means;

a holding mechanism configured for holding the second end of the band part, in the lengthwise direction pulled by the tightening mechanism, on the tool body so as to prevent return movement toward the head part;

a switching lever configured for positionally shifting relative to the tool body to switch operation of the first operating means between operation of the tightening mechanism and a securing mechanism, the switching lever:

mounted on the first operating means via a pivot pin;

configured to, when the first operating means is in a non-operating position, rotatably shift relative to the first operating means and about the pivot pin from a first switching-operation position to a second switching-operation position; and configured to, when the first operating means is positionally shifted between the non-operating position and an operating position, positionally shift relative to the tool body and not positionally shift relative to the first operating means; and the securing mechanism, the securing mechanism configured for securing a portion of the second end of the band part, which passes through the setting part, to the first end of the band part in response to positionally shifting the switching lever;

a release operation means configured for positionally shifting relative to the tool body; and a release mechanism configured for releasing a hold on the second end of the band part by the holding mechanism in response to positionally shifting the release operation means.

2. The manual bundling tool according to claim 1, wherein:

the housing includes a front end and a rear end separated by an intermediate part;

the front end of the housing is narrower than the rear end of the housing; and the setting part is disposed on the front end of the tool body.

3. The manual bundling tool according to claim 1, wherein the setting part is provided on the tool body such that the second end of the band part in the lengthwise direction after passing through the setting part is positioned on a side of the housing opposite the handle.

4. The manual bundling tool according to claim 1, wherein the setting part is mounted on the housing such that it can be attached and detached.

5. The manual bundling tool according to claim 1, wherein positionally shifting the first operating means to operate the tightening mechanism causes a switching pin to engage with a tightening lever of the tightening mechanism and disables switching by the switching operation means by preventing the switching pin from engaging with a disconnect mechanism configured for disconnecting the second end of the band part from the first end of the band part.

6. The manual bundling tool according to claim 1, comprising a disconnect mechanism configured for disconnecting the second end of the band part from the first end of the band part in the lengthwise direction of the band part in response to positionally shifting the switching lever.

7. The manual bundling tool according to claim 1, wherein when the switching lever is in the first switching-operation position, the switching lever is held at the first switching-operation position by a force of a kick spring.

8. The manual bundling tool according to claim 7, wherein when the switching lever is operated against the force of the kick spring, the switching lever is rotated about the pivot pin toward the second switching-operation position.

9. The manual bundling tool according to claim 8, wherein when operation of the switching lever against the force of the kick spring ends, the switching lever is rotated by the force of the kick spring to return to the first switching-operation position.

10. The manual bundling tool according to claim 7, wherein positionally shifting the switching lever against the force of the kick spring, while the first operating means is at the non-operating position, causes a switching pin to engage the securing mechanism.

11. The manual bundling tool according to claim 1, wherein, when the first operating means is positionally shifted from the non-operating position to the operating position, a switching pin engages an indentation of the tightening mechanism.

* * * * *